US012504246B2

(12) United States Patent
Sims

(10) Patent No.: US 12,504,246 B2
(45) Date of Patent: Dec. 23, 2025

(54) FIREARM GAS SYSTEMS

(71) Applicant: Chad Brandon Sims, Locust Grove, GA (US)

(72) Inventor: Chad Brandon Sims, Locust Grove, GA (US)

(73) Assignee: Argos Ordnance, Inc., Locust Grove, GA (US)

( * ) Notice: Subject to any disclaimer, the term of this patent is extended or adjusted under 35 U.S.C. 154(b) by 34 days.

(21) Appl. No.: 18/406,191

(22) Filed: Jan. 7, 2024

(65) Prior Publication Data

US 2024/0230260 A1 Jul. 11, 2024

Related U.S. Application Data

(60) Provisional application No. 63/437,789, filed on Jan. 9, 2023.

(51) Int. Cl.
*F41A 5/28* (2006.01)

(52) U.S. Cl.
CPC ..... *F41A 5/28* (2013.01)

(58) Field of Classification Search
CPC ..... F41A 5/26; F41A 5/28
See application file for complete search history.

(56) References Cited

U.S. PATENT DOCUMENTS 2,340,293 A * 2/1944 Balleisen ..... F41A 5/28 89/193
2,582,989 A * 1/1952 Harvey ..... F41A 5/26 89/193
2,715,858 A * 8/1955 Hoppert ..... F41A 5/28 89/193
2,748,662 A * 6/1956 Simpson ..... F41A 5/28 251/207
2,777,366 A * 1/1957 Cook ..... F41A 5/26 89/193
4,244,273 A * 1/1981 Langendorfer, Jr. ..... F41A 5/18 89/193
7,461,581 B2 * 12/2008 Leitner-Wise ..... F41A 3/12 89/191.01
7,891,284 B1 2/2011 Barrett
8,161,864 B1 4/2012 Vuksanovich
8,443,711 B2 * 5/2013 Clark ..... F41A 5/18 89/193
9,506,704 B2 * 11/2016 Gomez ..... F41A 5/28
9,523,543 B1 * 12/2016 Brown ..... F41A 5/26
9,625,225 B2 4/2017 Sylvester
9,766,027 B1 * 9/2017 Cavanaugh ..... F41A 5/24
9,995,546 B2 * 6/2018 Schilling ..... F41A 5/28
10,753,692 B1 * 8/2020 Thompson ..... F41A 21/482
10,816,288 B1 * 10/2020 Oglesby ..... F41A 5/28
11,015,883 B2 5/2021 Sylvester
11,175,105 B2 * 11/2021 Schilling ..... F41A 5/28
11,287,200 B1 * 3/2022 Oglesby ..... F41A 21/325
(Continued)

*Primary Examiner* — Derrick R Morgan

(57) ABSTRACT

A firearm operating system is designed for a firearm with a barrel and a bolt carrier group. The firearm operating system includes a gas block secured to the barrel, the gas block comprising an upper hole, a gas plug disposed in the upper hole, a tension nut disposed on a forward side of the gas block, and a removably attached gas directing assembly. The gas plug includes multiple adjustment configurations. The removably attached gas directing assembly interfaces with the bolt carrier group.

20 Claims, 25 Drawing Sheets

(56) References Cited

U.S. PATENT DOCUMENTS 11,287,201 B1 * 3/2022 Underwood ..... F41A 5/26
11,614,299 B1 * 3/2023 Oglesby ..... F41A 5/26 89/193
11,994,357 B2 * 5/2024 Salinas ..... F41A 5/28
2009/0120277 A1 * 5/2009 Adams ..... F41A 5/26 89/179
2010/0186582 A1 * 7/2010 Juarez ..... F41A 5/28 89/191.01
2010/0218671 A1 * 9/2010 Mayberry ..... F41A 5/28 89/192
2011/0023699 A1 * 2/2011 Barrett ..... F41A 5/28 89/193
2012/0167756 A1 * 7/2012 Larue ..... F41A 21/28 89/193
2012/0167757 A1 * 7/2012 Gomez ..... F41A 5/28 89/193
2013/0055883 A1 * 3/2013 Cassels ..... F41A 5/28 89/193
2014/0033590 A1 * 2/2014 Gomez ..... F41A 5/26 42/75.02
2014/0060313 A1 * 3/2014 Iredale Clark ..... F41A 5/18 89/193
2014/0260947 A1 * 9/2014 Gomez ..... F41G 1/02 89/193
2015/0176933 A1 * 6/2015 Adams ..... F41A 5/28 89/191.02
2015/0204627 A1 * 7/2015 Gomez ..... F41A 5/28 89/193
2015/0292825 A1 * 10/2015 Cassels ..... F41A 5/28 89/193
2015/0308764 A1 * 10/2015 Kenney ..... F41A 5/26 89/193
2016/0047614 A1 * 2/2016 Larson, Jr. ..... F41G 11/003 89/191.01
2016/0265860 A1 * 9/2016 Schilling ..... F41A 5/28
2017/0276445 A1 * 9/2017 Daley, Jr. ..... F41A 5/26
2019/0212083 A1 * 7/2019 Konev ..... F41C 27/22
2019/0242663 A1 * 8/2019 Miller ..... F41A 5/28
2020/0025476 A1 * 1/2020 Aubin ..... F41A 5/26
2020/0025498 A1 * 1/2020 Wheeler ..... F41A 21/325
2021/0389066 A1 12/2021 Sylvester
2022/0307783 A1 * 9/2022 Puha ..... F41A 5/26
2023/0125921 A1 * 4/2023 Keeney ..... F41A 5/28 89/193
2023/0204312 A1 * 6/2023 Schilling ..... F41A 5/28 89/193
2023/0228507 A1 * 7/2023 Fisher ..... F41A 5/26 89/193
2024/0068759 A1 * 2/2024 Puha ..... F41A 5/28
2024/0085129 A1 * 3/2024 Zheng ..... F41A 5/26
2024/0288237 A1 * 8/2024 Gangl ..... F41A 5/28
2025/0012527 A1 * 1/2025 Salinas ..... F41A 5/28

* cited by examiner

FIREARM GAS SYSTEMS

CROSS REFERENCE TO RELATED APPLICATION

This application is related to and claims priority benefit from U.S. Provisional Application No. 63/437,789 ("the '789 application"), filed on Jan. 9, 2023. The '789 application is hereby incorporated in its entirety by this reference.

FIELD OF THE INVENTION

The field of the invention relates to firearm operating systems, particularly gas systems for firearms designed for autoloading firearms.

BACKGROUND

Many modern firearms (including handguns, rifles, carbines, shotguns, etc.) rely on operating systems using gas pressure (including direct gas impingement arrangements, gas piston arrangements, or other appropriate arrangements). However, many of these firearms are not adjustable for adapting to varying ammunition and other factors (such as the presence of a suppressor or other muzzle device). Furthermore, typical firearms are not modular with the capability of being configured for multiple types of operating systems.

To increase the capabilities, ergonomics, and effectiveness of firearm gas operating systems, it may be desirable to design new gas operating systems that are (i) modular for multiple types of gas operating arrangements and/or (ii) adjustable for different ammunition, accessories, and circumstances.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

According to certain embodiments of the present invention, a firearm operating system for a firearm with a barrel and a bolt carrier group, the firearm operating system comprises: a gas block secured to the barrel, the gas block comprising an upper hole; a gas plug disposed in the upper hole; a tension nut disposed on a forward side of the gas block; and a removably attached gas directing assembly, wherein: the gas plug comprises multiple adjustment configurations; and the removably attached gas directing assembly interfaces with the bolt carrier group.

DETAILED DESCRIPTION

Figure 1:
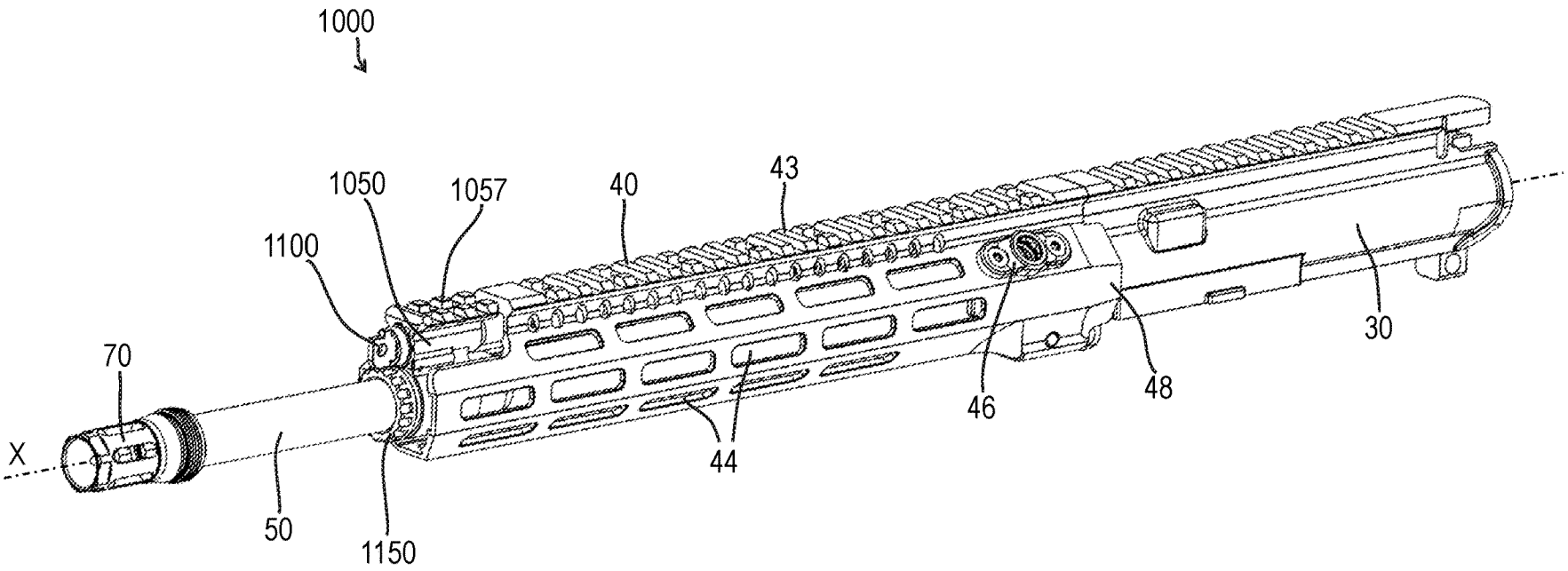
FIG. 1 is a front perspective view of a firearm upper receiver assembly with a firearm operating system according to certain embodiments of the present invention.
Figure 2A:
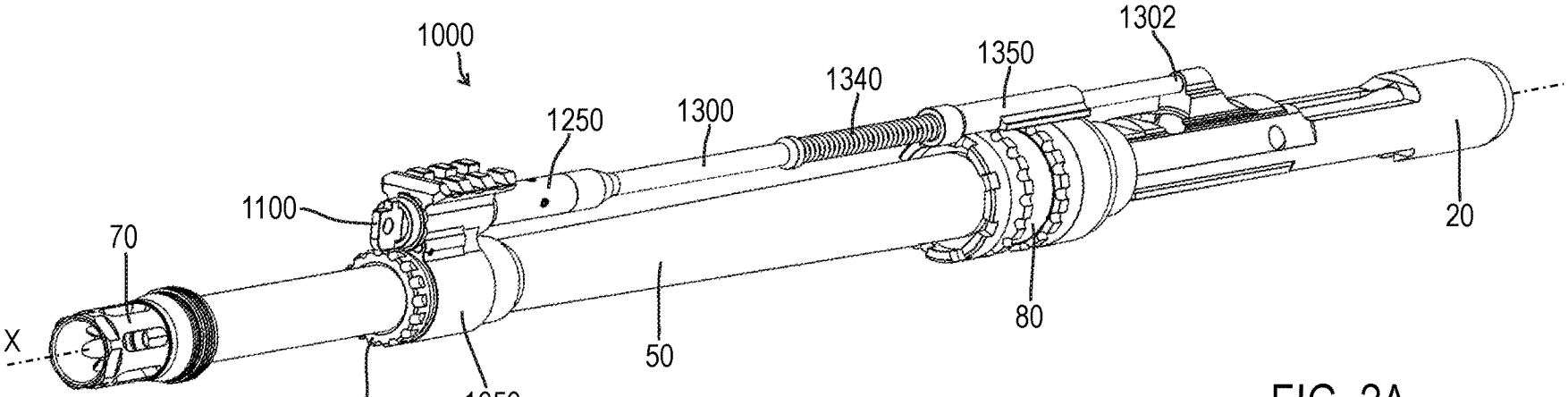
FIG. 2A is a front perspective view of the firearm operating system of FIG. 1.
Figure 2B:
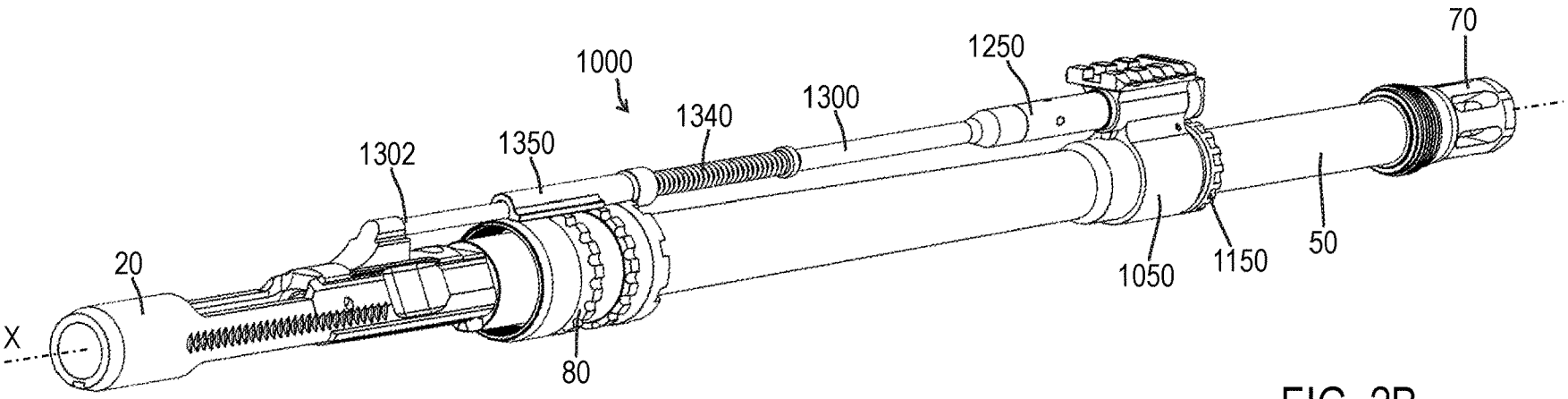
FIG. 2B is a rear perspective view of the firearm operating system of FIG. 2A.
Figure 3:
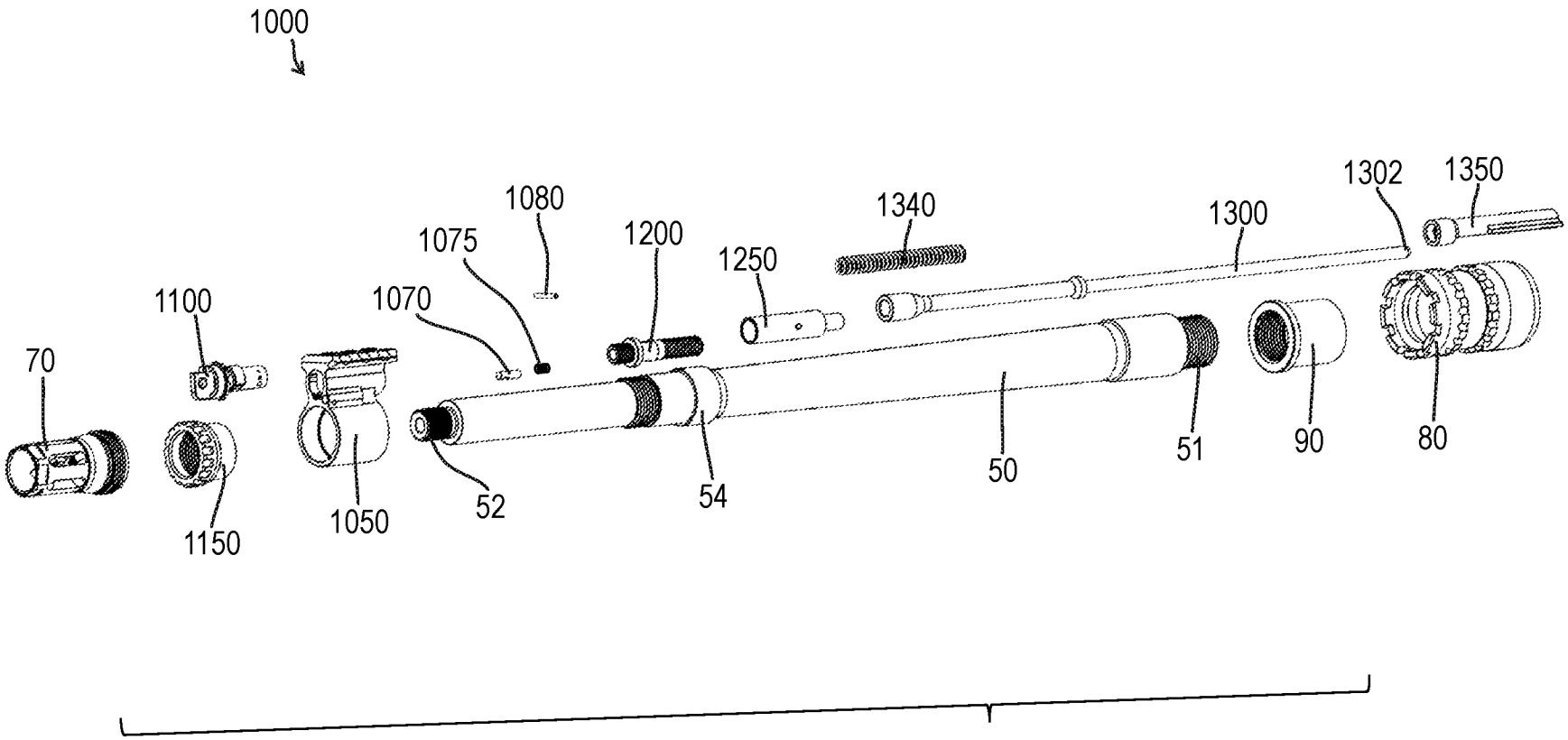
FIG. 3 is a front perspective exploded view of the firearm operating system of FIG. 1.

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Although the illustrated embodiments shown in FIGS. 1-18B illustrate components of various semi-automatic or automatic firearms, the features, concepts, and functions described herein are also applicable (with potential necessary alterations for particular applications) to handguns, rifles, carbines, pistols, shotguns, or any other type of firearm. Furthermore, the embodiments may be compatible with various calibers including rifle calibers such as, for example, 5.56×45 mm NATO, 0.223 Remington, 7.62×51 mm NATO, .308 Winchester, 7.62×39 mm, 5.45×39 mm; pistol calibers such as, for example, 9×19 mm, 45 ACP, 0.40 S&W, 0.380 ACP, 10 mm Auto, 5.7×28 mm; and shotgun calibers such as, for example, 12 gauge, 20 gauge, 28 gauge, 0.410 gauge, 10 gauge, 16 gauge.

In some embodiments, the firearm operating systems 1000 are configured to work in conjunction with and/or be inserted into a U.S. military specification (milspec) upper receiver for an AR-15 variant (civilian) or M16/M4 (military) firearm (i.e., collectively AR-15 style firearms).

According to certain embodiments of the present invention, as shown in FIGS. 1-14D, a firearm operating system 1000 may include a gas block 1050, a gas plug 1100, a tension nut 1150, a gas piston 1200, a piston cup 1250, an operating rod 1300, an operating rod spring 1340, and/or an operating rod guide 1350. The firearm operating system 1000 may be incorporated into a firearm that includes a bolt carrier group 20, an upper receiver 30, a handguard 40, a barrel 50, a muzzle device 70, a barrel nut 80, and a barrel extension 90 (e.g., see FIG. 1). Other components (e.g., lower receiver, magazine, charging handle, etc.) are not illustrated for simplicity. In some cases, the firearm operating system 1000 is located within the upper receiver 30 and/or the handguard 40. The firearm operating system 1000 may be designed as an assembly of components to fit within a standard handguard and/or upper receiver for a known modular firearm such that the upper receiver 30 and handguard 40 (including the firearm operating system 1000) can interface with a standard lower receiver. For example, the firearm operating system 1000 may be designed to function and engage with (i) components of AR-15 variant (civilian) or M16/M4 (military) firearms; (ii) components of AR-10 variant firearms; or (iii) components of any other relevant firearm.

In some embodiments, the firearm operating system 1000 allows an operator to adjust the gas system of the firearm with multiple adjustment configurations to account for various factors including, but not limited to, ammunition powder charge, ammunition velocity, muzzle device (including compensators, muzzle brakes, suppressors, etc.), environmental factors, cleanliness of system, perceived recoil, auditory profile, and/or any other relevant consideration. In addition, the firearm operating system 1000 may be a modular system allowing an operator to switch between different types operating system including, but not limited to, piston-driven gas systems, direct impingement (DI) gas systems, a single shot non-cycling system (similar in function to a bolt-action firearm), and/or any other appropriate type of operating system.

Figure 4A:
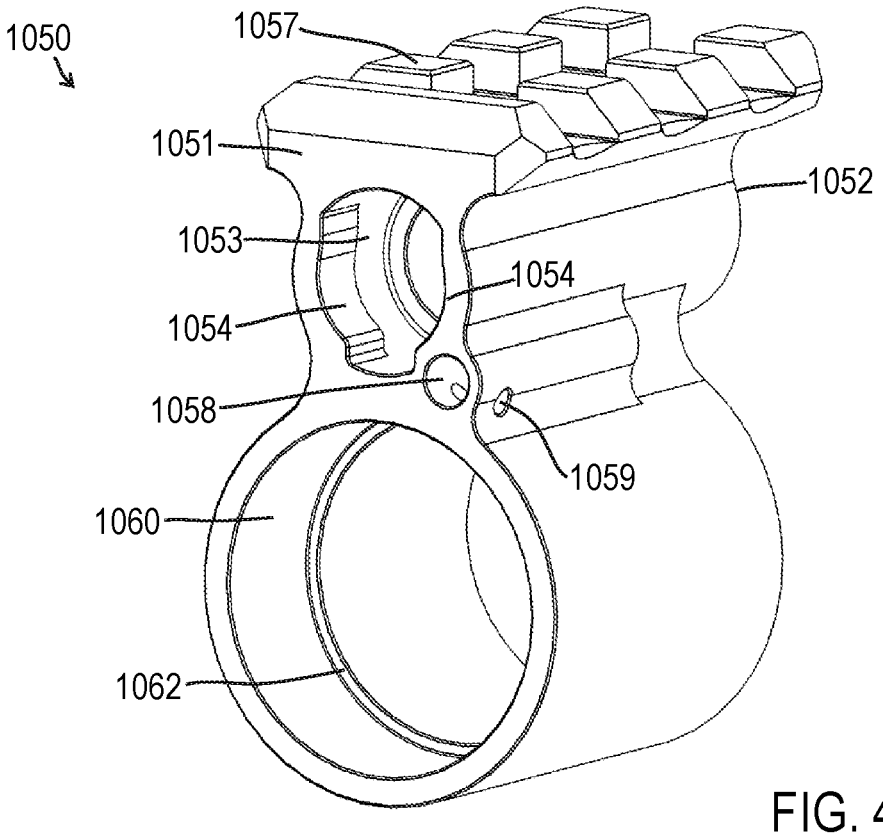
FIG. 4A is a front perspective view of a gas block of the firearm operating system of FIG. 1.
Figure 4B:
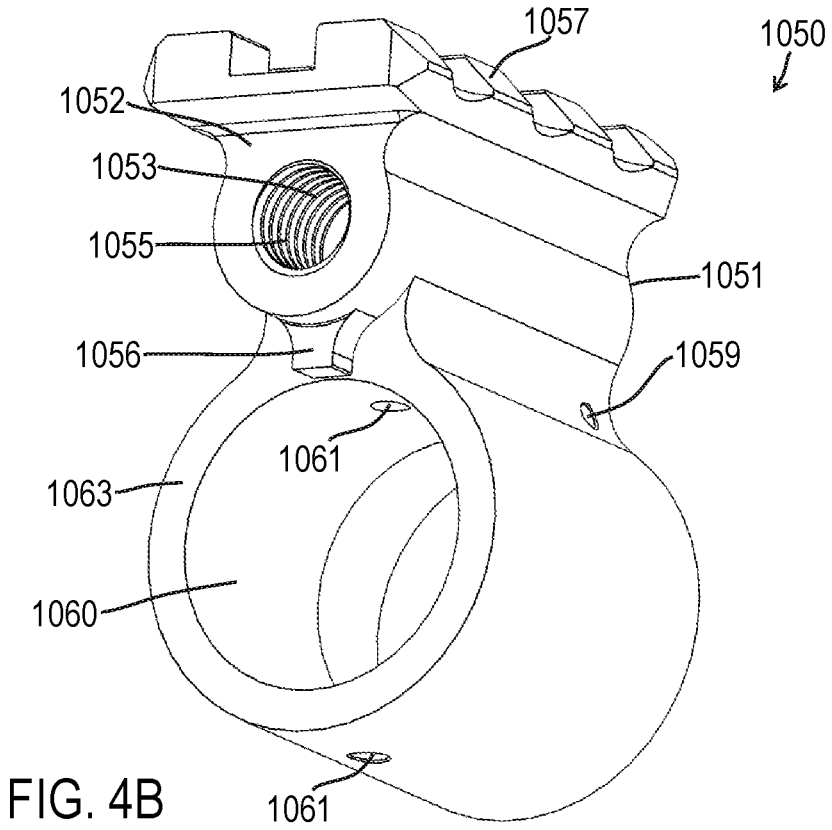
FIG. 4B is a rear perspective view of the gas block of FIG. 4A.
Figure 4C:
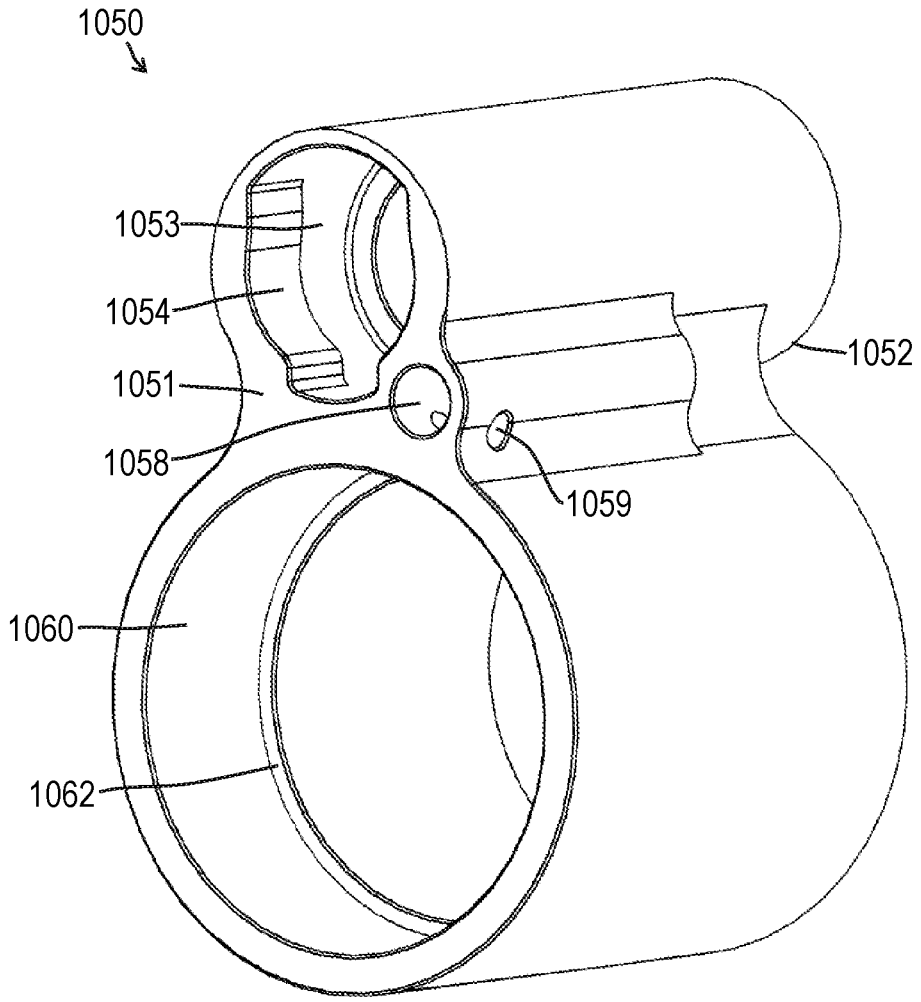
FIG. 4C is a front perspective view of a gas block of the firearm operating system of FIG. 1.

As shown in FIGS. 4A-4C, the gas block 1050 may include a forward end 1051, a rear end 1052, an upper hole 1053, a front attachment feature 1054, a rear attachment feature 1055, a rear locating feature 1056, an upper feature 1057, an intermediate hole 1058, a transverse hole 1059, a lower hole 1060, a gas hole 1061, an inner feature 1062, and/or a rear lower surface 1063.

Figure 5A:
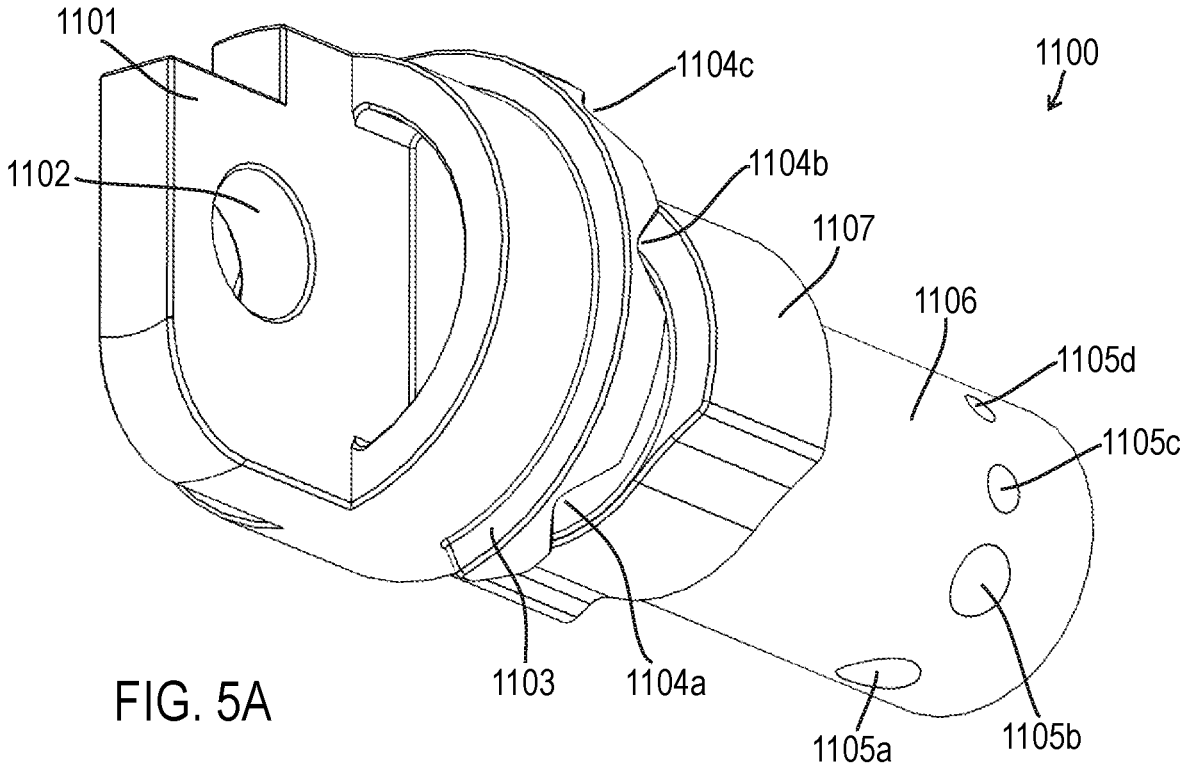
FIG. 5A is a front perspective view of a gas plug of the firearm operating system of FIG. 1.
Figure 5B:
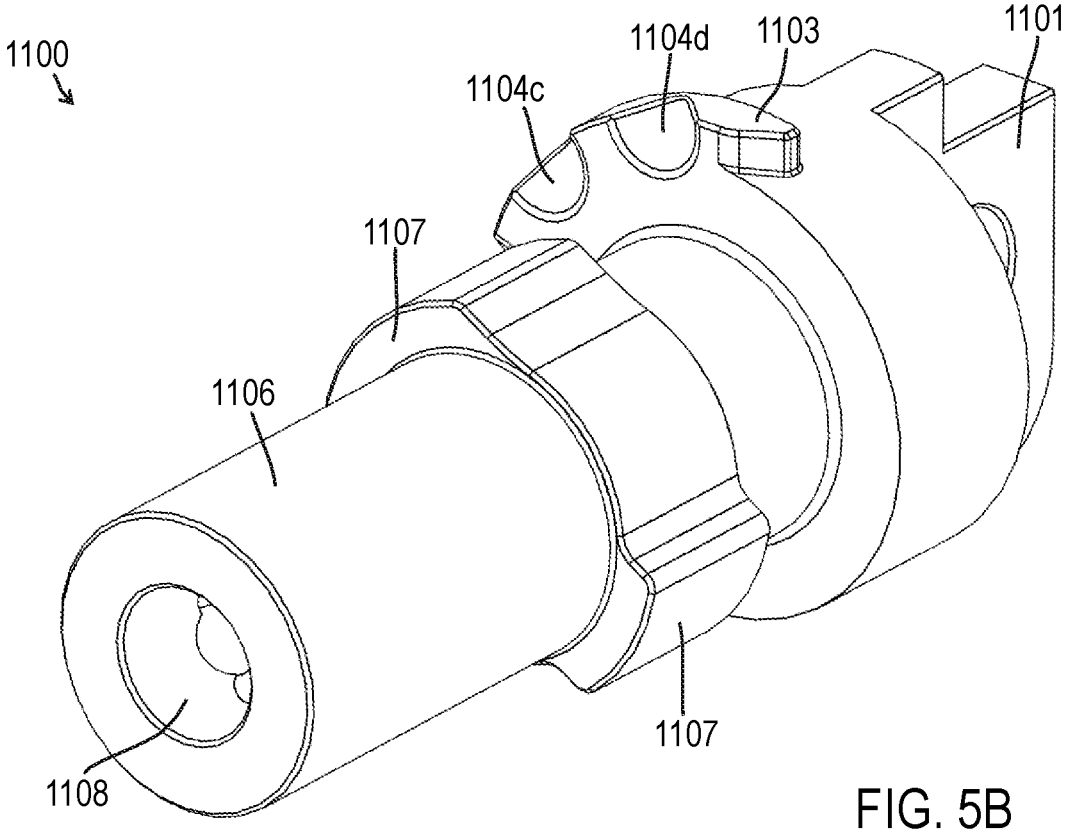
FIG. 5B is a rear perspective view of the gas plug of FIG. 5A.

Some examples of the gas plug 1100 are shown in FIGS. 5A and 5B. The gas plug 1100 may include a handle 1101, a handle hole 1102, a flange 1103, at least one notch 1104, at least one gas hole 1105, a protrusion 1106, at least one locking feature 1107, and/or a central passage 1108.

Figure 6A:
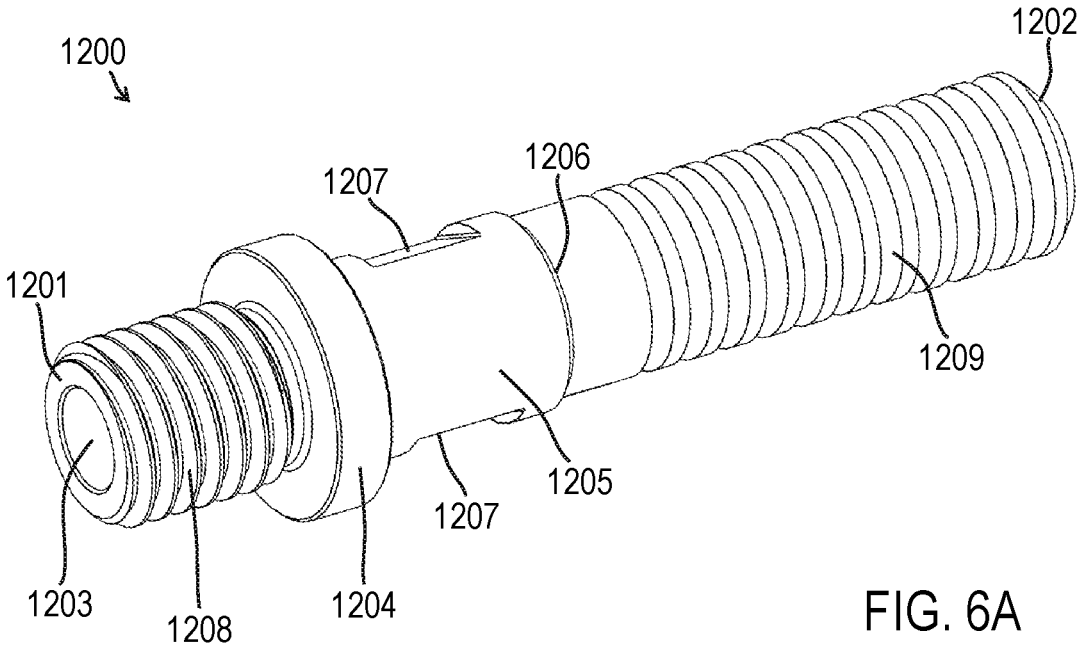
FIG. 6A is a front perspective view of a gas piston of the firearm operating system of FIG. 1.
Figure 6B:
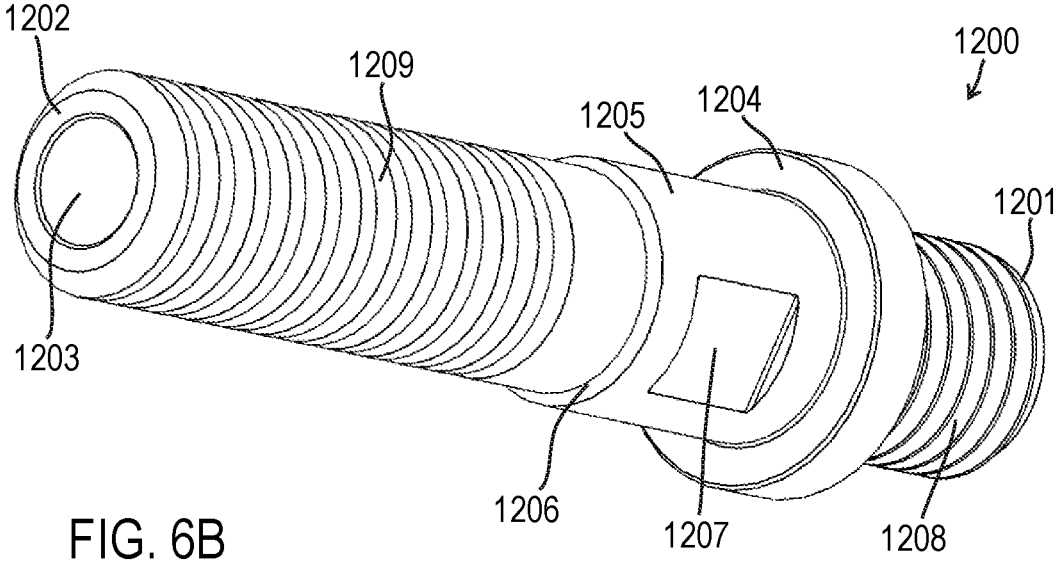
FIG. 6B is a rear perspective view of the gas piston of FIG. 6A.

As shown in FIGS. 6A and 6B, the gas piston 1200 may include a forward end 1201, a rear end 1202, a central passage 1203, a flange 1204, a rear protrusion 1205, an outer feature 1206, at least one tool interface portion 1207, a forward attachment portion 1208, and/or a ribbed portion 1209. In some embodiments, the purpose of the ribbed portion(s) 1209 is to provide a series of ribs and/or grooves to reduce the amount of fouling and carbon buildup on the gas piston 1200. In some cases, these features (i) allow gases and carbon to flow past the gas piston 1200 (*ii*) enhance the effect of scraping due to the movement of the piston cup 1250 (as described below) to remove fouling or carbon, and (iii) limit the surface area of the gas piston 1200 that can contact the inside of the piston cup 1250.

Figure 7A:
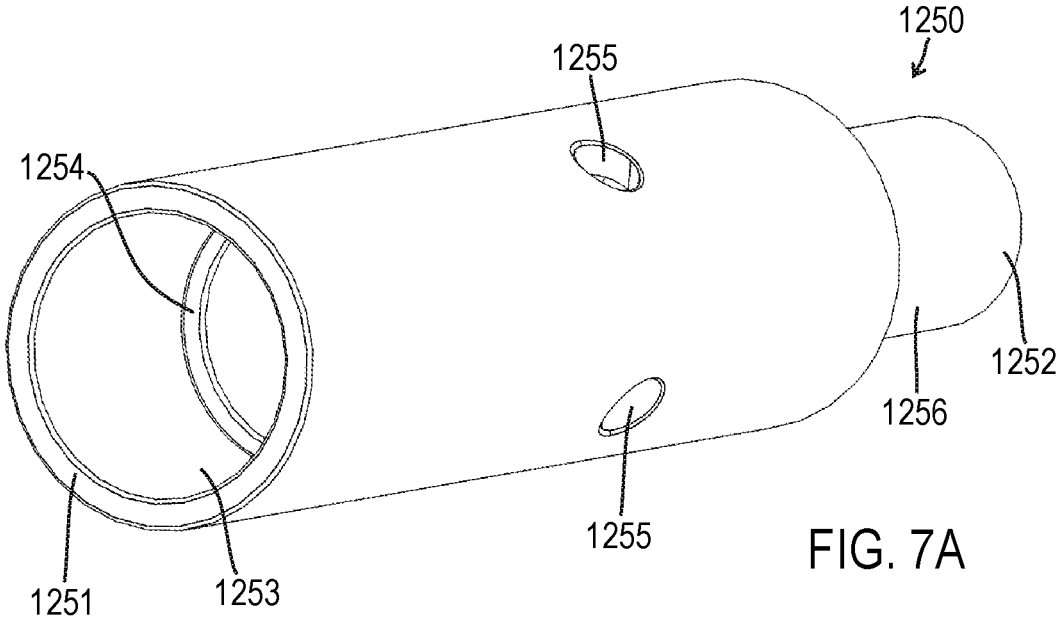
FIG. 7A is a front perspective view of a piston cup of the firearm operating system of FIG. 1.
Figure 7B:
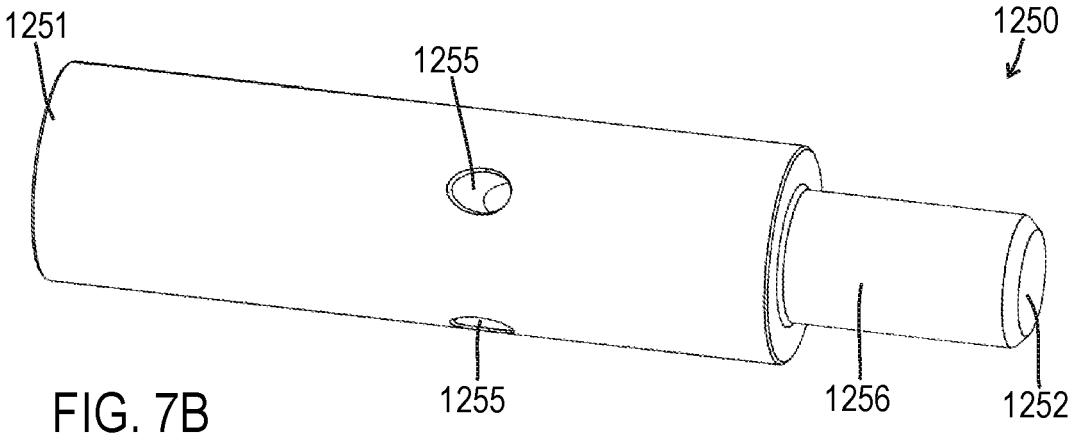
FIG. 7B is a rear perspective view of the piston cup of FIG. 7A.
Figure 7C:
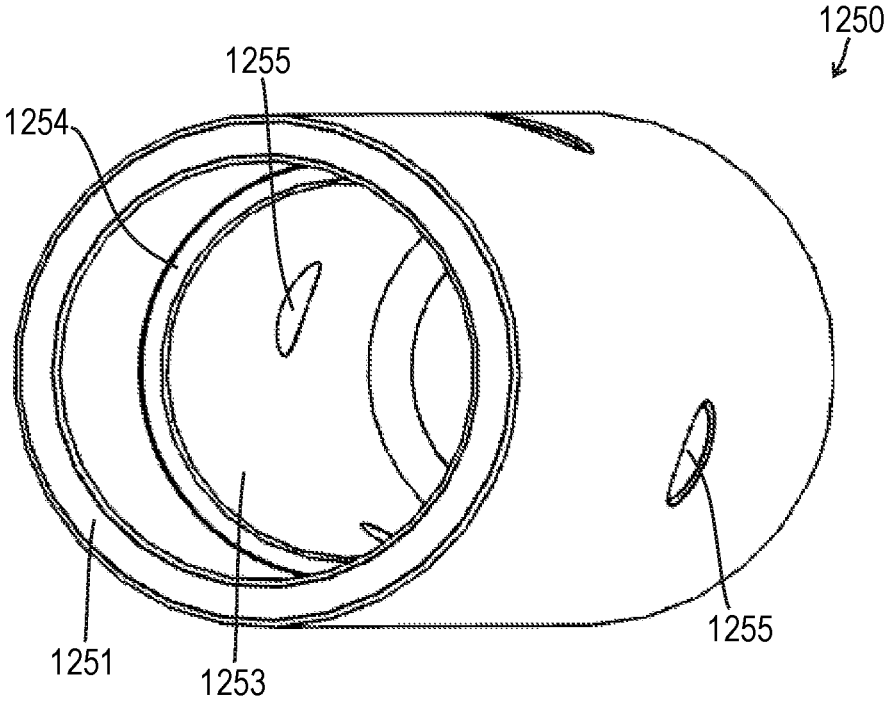
FIG. 7C is a front perspective view of a piston cup of the firearm operating system of FIG. 1.
Figure 7D:
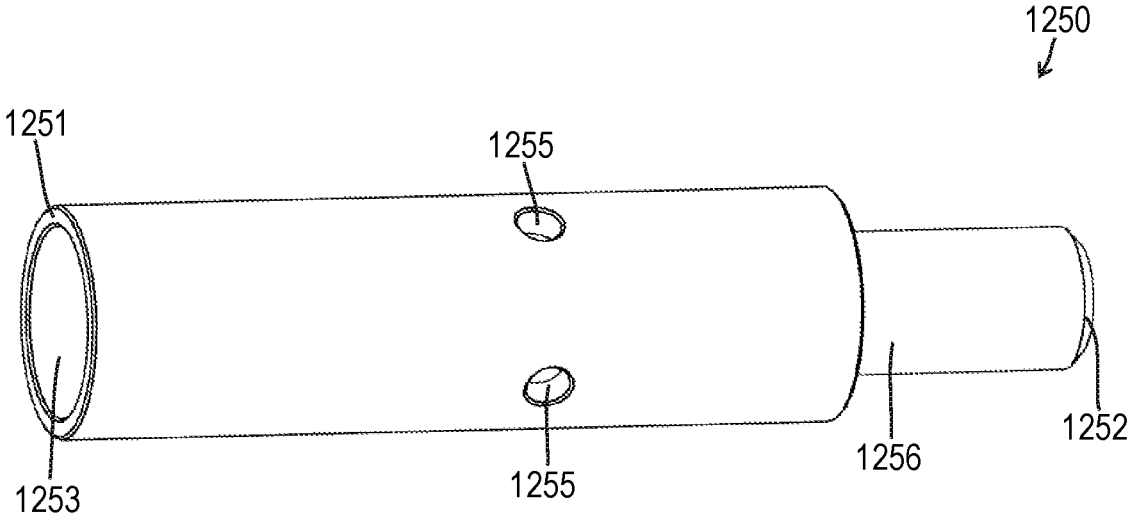
FIG. 7D is a front perspective view of the piston cup of FIG. 7C.

Some embodiments of the piston cup 1250 are illustrated in FIGS. 7A-7D. The piston cup 1250 may include a forward end 1251, a rear end 1252, an internal cavity 1253, an internal feature 1254, at least one gas port 1255, and/or a rear protrusion 1256. As shown in FIGS. 7A and 7B, the piston cup 1250 may include a plurality of gas ports 1255 that are angled/tapered toward the forward end 1251 of the piston cup 1250. In other words, in some embodiments, the gas port(s) 1255 are oblique to the forward/aft axial direction of the piston cup 1250. In other embodiments, as shown in FIGS. 7C and 7D, the gas port(s) 1255 are perpendicular to the forward/aft axial direction of the piston cup 1250. Although the illustrations show four gas ports 1255, the piston cup 1250 may include any number of gas port(s) 1255 including as few as one or as many as 100.

Figure 8A:
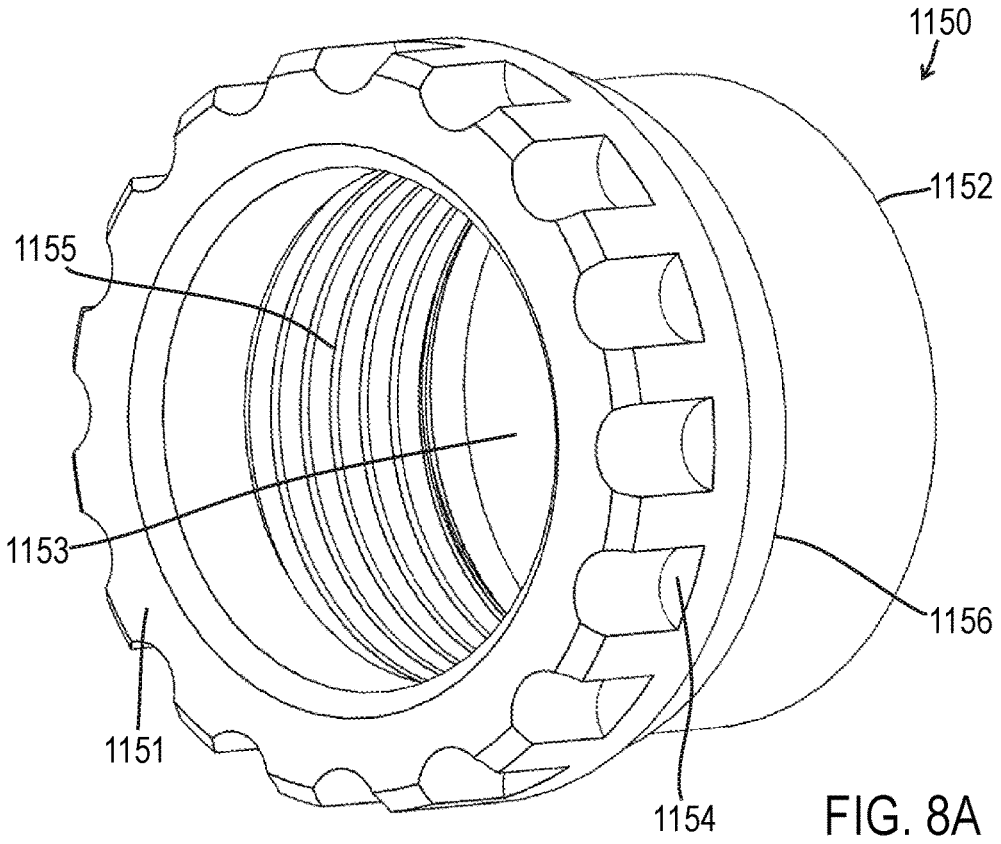
FIG. 8A is a front perspective view of a tension nut of the firearm operating system of FIG. 1.
Figure 8B:
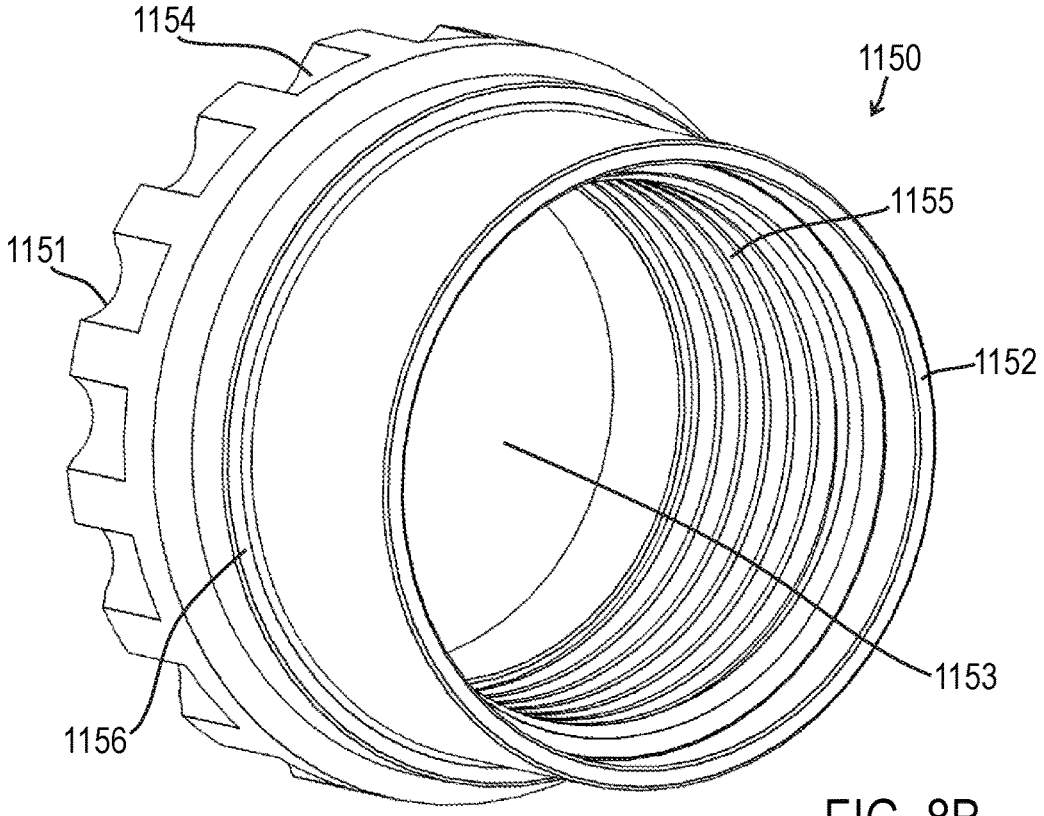
FIG. 8B is a rear perspective view of the tension nut of FIG. 8A.

As shown in FIGS. 8A and 8B, the tension nut 1150 may include a forward end 1151, a rear end 1152, a central passage 1153, at least one tool interface 1154, a rear attachment portion 1155, and/or an external feature 1156.

Figure 9A:
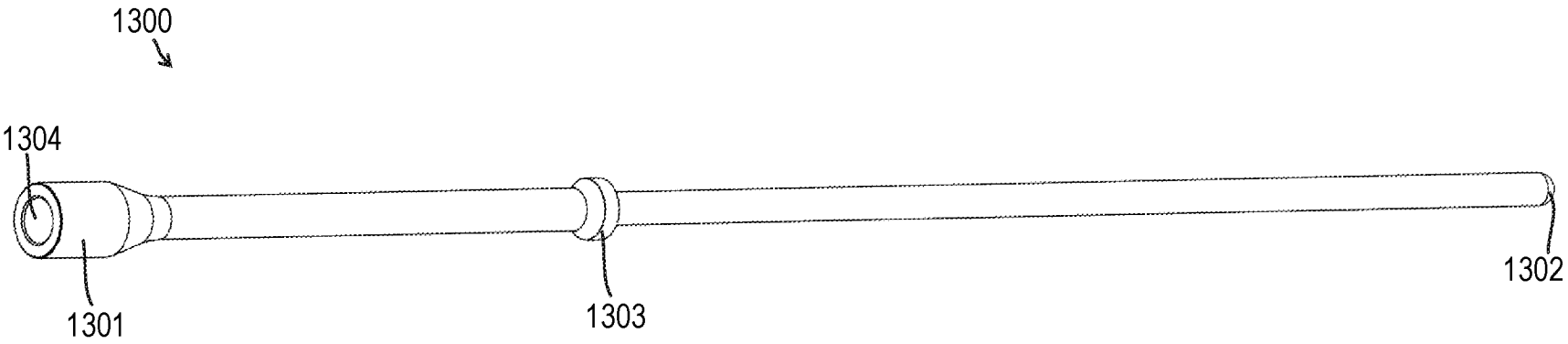
FIG. 9A is a front perspective view of an operating rod of the firearm operating system of FIG. 1.
Figure 9B:
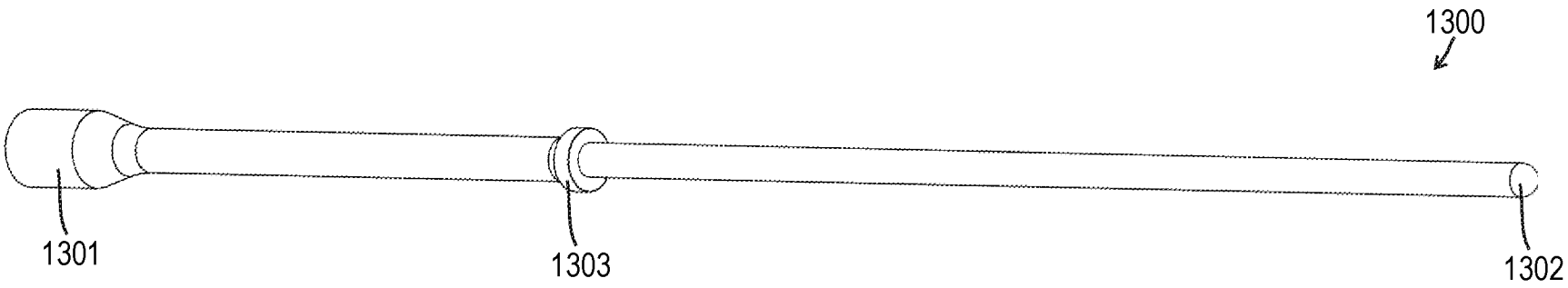
FIG. 9B is a rear perspective view of the operating rod of FIG. 9A.
Figure 9C:
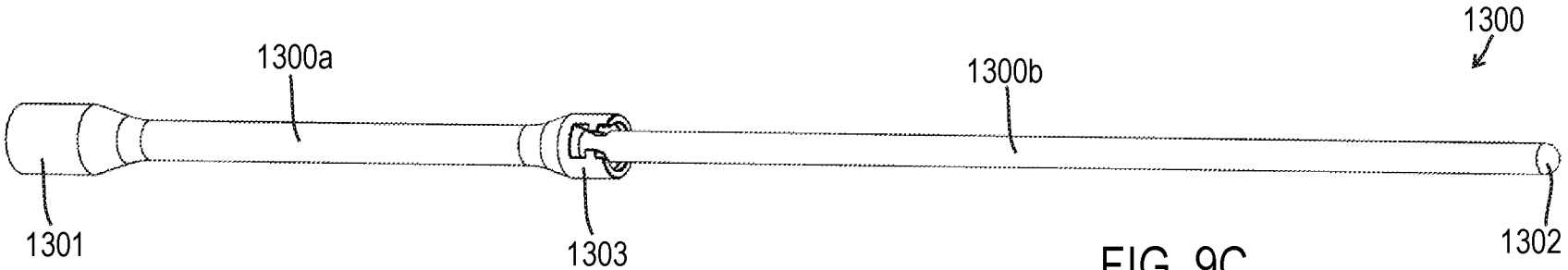
FIG. 9C is a rear perspective view of an operating rod of the firearm operating system of FIG. 1.
Figure 9D:
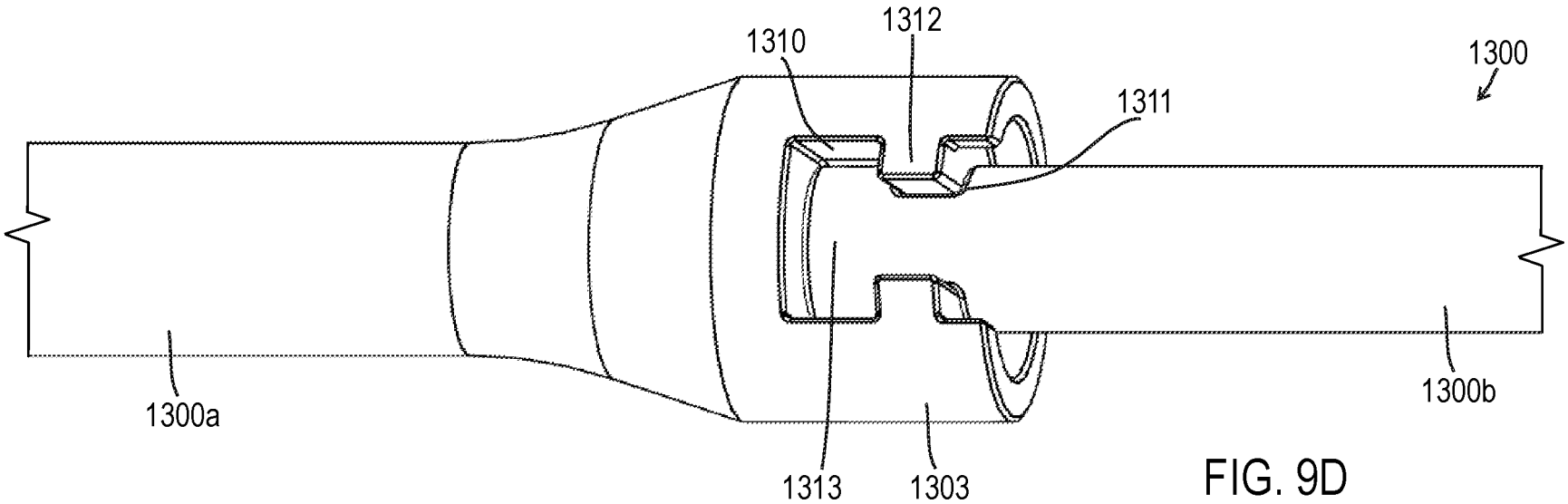
FIG. 9D is a perspective detail view of the operating rod of FIG. 9C.

Some embodiments of the operating rod 1300 are illustrated in FIGS. 9A-9D. The operating rod 1300 may include a forward end 1301, a rear end 1302, a flange 1303, and/or an internal cavity 1304. As shown in FIGS. 9A and 9B, the operating rod 1300 may be a single component. In other embodiments, as shown in FIGS. 9C and 9D, the operating rod 1300 may include a forward portion 1300*a* and a rear portion 1300*b* that are removably attached to one another at the flange 1303. In some embodiments, the flange 1303 is a portion of the forward portion 1300*a* and includes a recess 1310 and a protrusion 1312. As shown in FIG. 9D, the rear portion 1300*b* may include (i) at least one notch 1311 that corresponds to the protrusion 1312 and (ii) a protrusion 1313 that corresponds to the recess 1310.

Figure 10A:
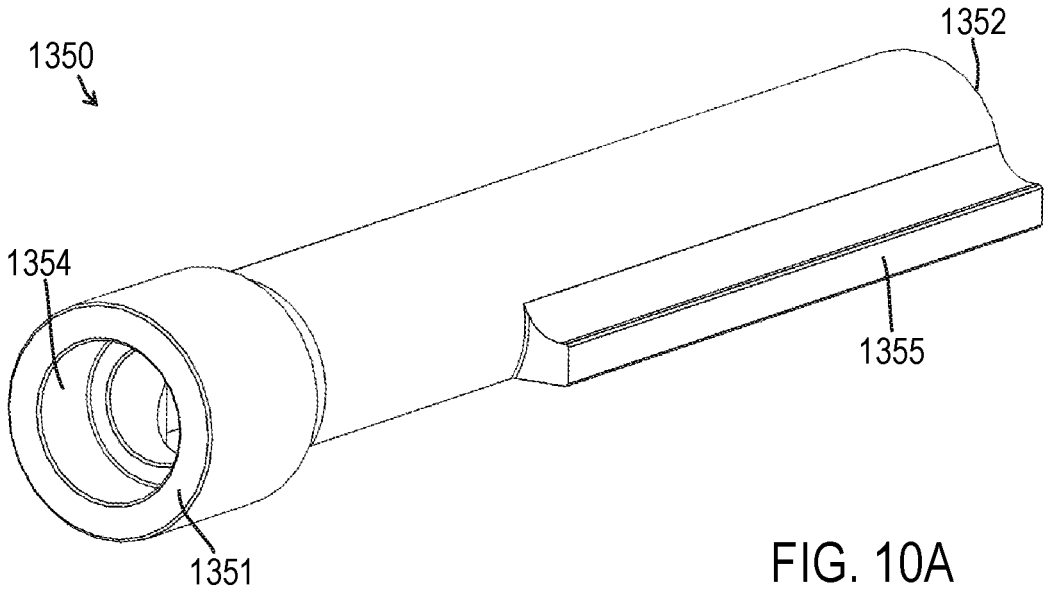
FIG. 10A is a front perspective view of an operating rod guide of the firearm operating system of FIG. 1.
Figure 10B:
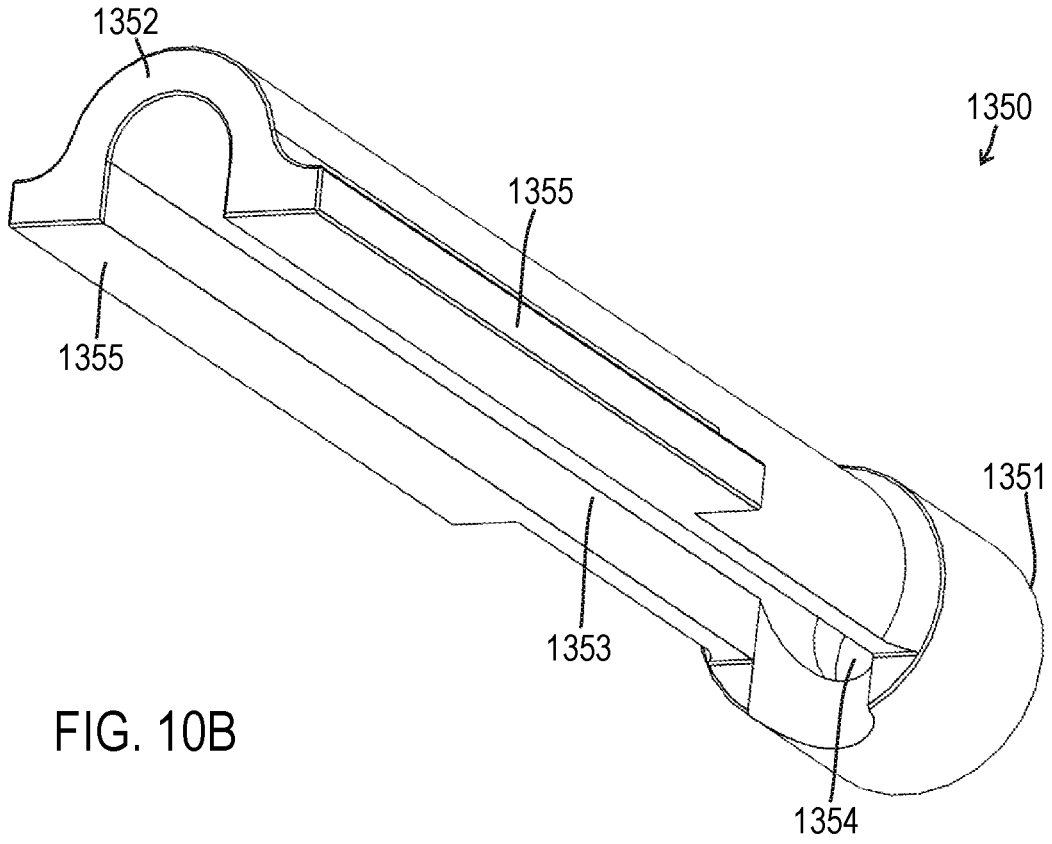
FIG. 10B is a rear perspective view of the operating rod guide of FIG. 10A.

As shown in FIGS. 10A and 10B, the operating rod guide 1350 may include a forward end 1351, a rear end 1352, a central cavity 1353, a forward hole 1354, and/or at least one lateral wing 1355. The operating rod guide 1350 may be arranged or fixed within the handguard 40 below the upper feature 43 and above the barrel nut 80 (see FIG. 14B). In some embodiments, the lateral wing(s) 1355 engage corresponding slots or grooves in the upper portion of the handguard 40.

Figure 11:
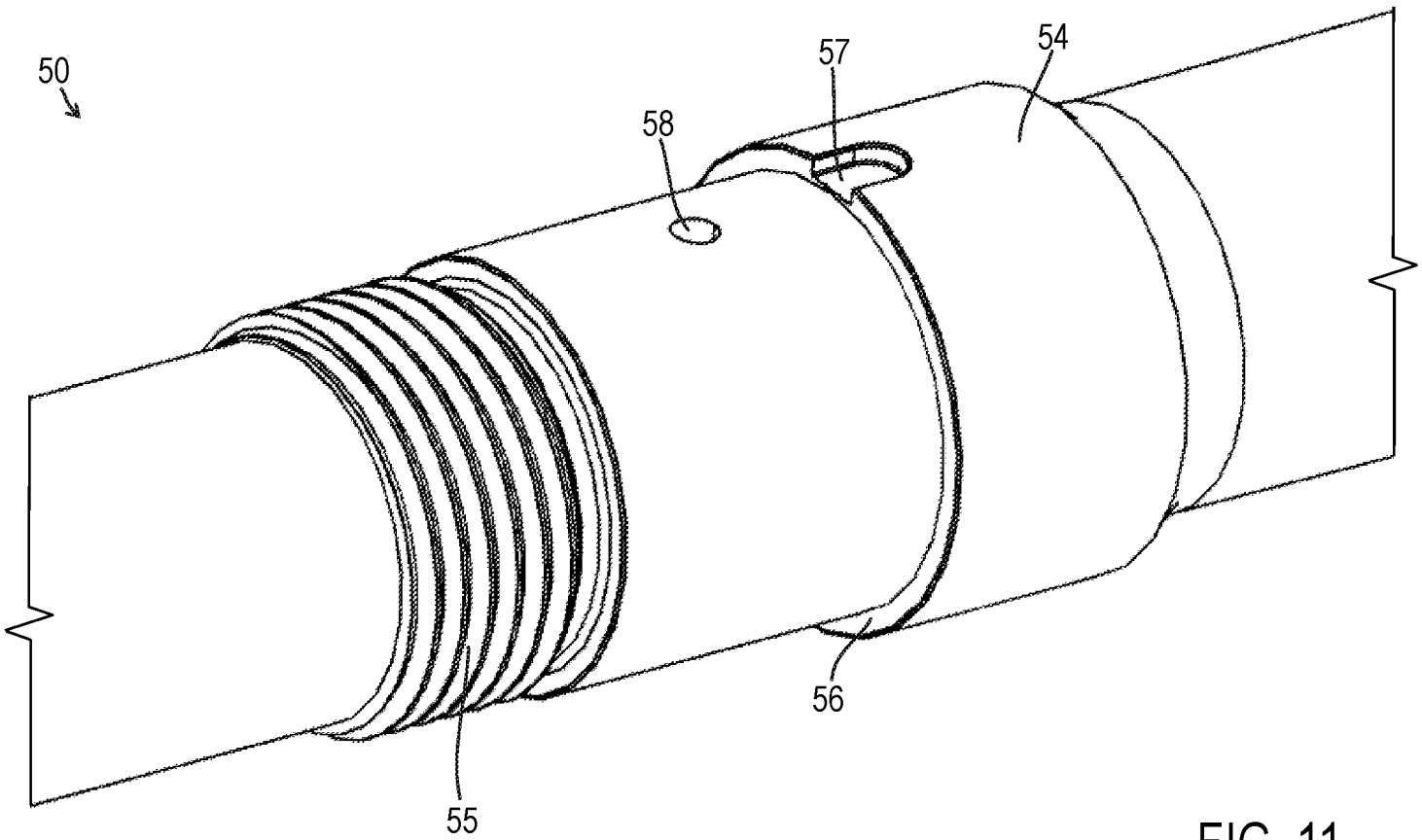
FIG. 11 is a perspective detailed view of a barrel of the firearm upper receiver assembly of FIG. 1.

The function and installation of the firearm operating systems 1000 includes the interaction between the gas block 1050 and the barrel 50. As shown in FIG. 11, the barrel 50 may include a flange 54 that forms a ledge 56 and includes a recess 57. Located forward of the flange 54 is a gas port 58 and an attachment portion 55. The gas block 1050 may be arranged such that the barrel 50 passes through the lower hole 1060 such that (i) the gas hole 1061 is aligned with the gas port 58, (ii) the rear lower surface 1063 is adjacent to and/or contacts the ledge 56, and (iii) the rear locating feature 1056 engages the recess 57. To prevent the gas block 1050 from moving forward relative to the barrel 50, the tension nut 1150 is passed down the barrel 50 from the muzzle such that barrel 50 is located within the central passage 1153. The rear attachment portion 1155 of the tension nut 1150 may engage the attachment portion 55 of the barrel 50. In some embodiments, these corresponding attachment portions include matching threaded portions. For example, the tension nut 1150 may be removably attached (e.g., threaded onto) the barrel 50 until (i) the rear end 1152 of the tension nut 1150 engages the inner feature 1062 of the gas block 1050 and/or (ii) the external feature 1156 of the tension nut 1150 engages the forward end 1051 of the gas block 1050. In some embodiments, installation of the tension nut 1150 includes using a wrench designed to engage two or more of the tool interface(s) 1154.

As shown in FIGS. 1, 2A, and 12A-C, the gas plug 1100 is inserted into the upper hole 1053 of the gas block 1050. Insertion requires orienting the gas plug 1100 such that the locking feature(s) 1107 avoid or clear the front attachment feature(s) 1054. In some embodiments, there are two locking features 1107 and two locking features 1107 while insertion requires turning the gas plug 1100 such that the locking features 1107 are arranged vertically to avoid the front attachment features 1054 (see FIGS. 4A, 4C, and 4D). After inserting the gas plug 1100 into the upper hole 1053, these components are mechanically secured to one another by rotating the gas plug 1100 such that the locking feature(s) 1107 engage the front attachment feature(s) 1054.

Figure 12A:
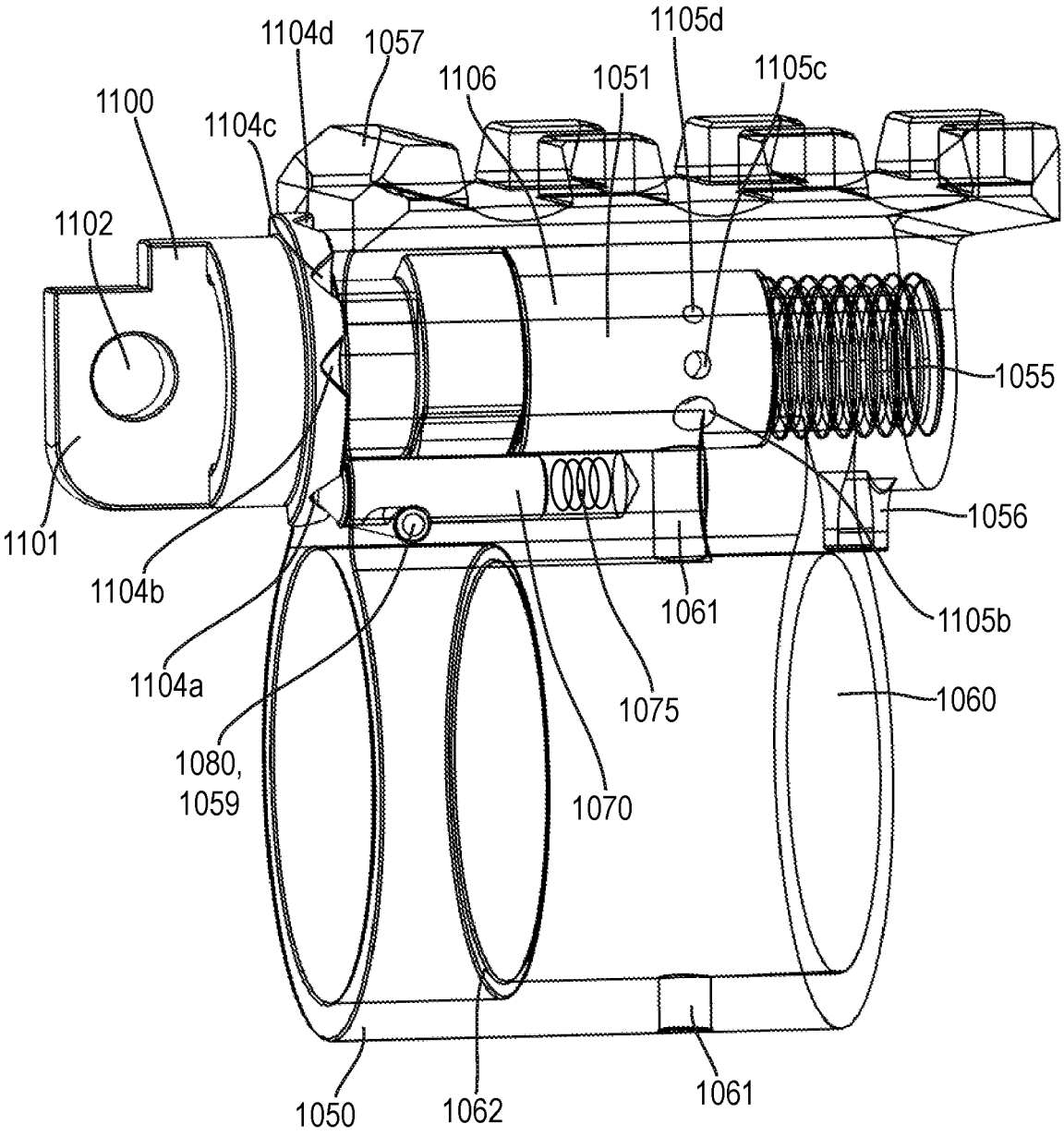
FIG. 12A is a perspective partial view of the firearm operating system of FIG. 1.
Figure 12B:
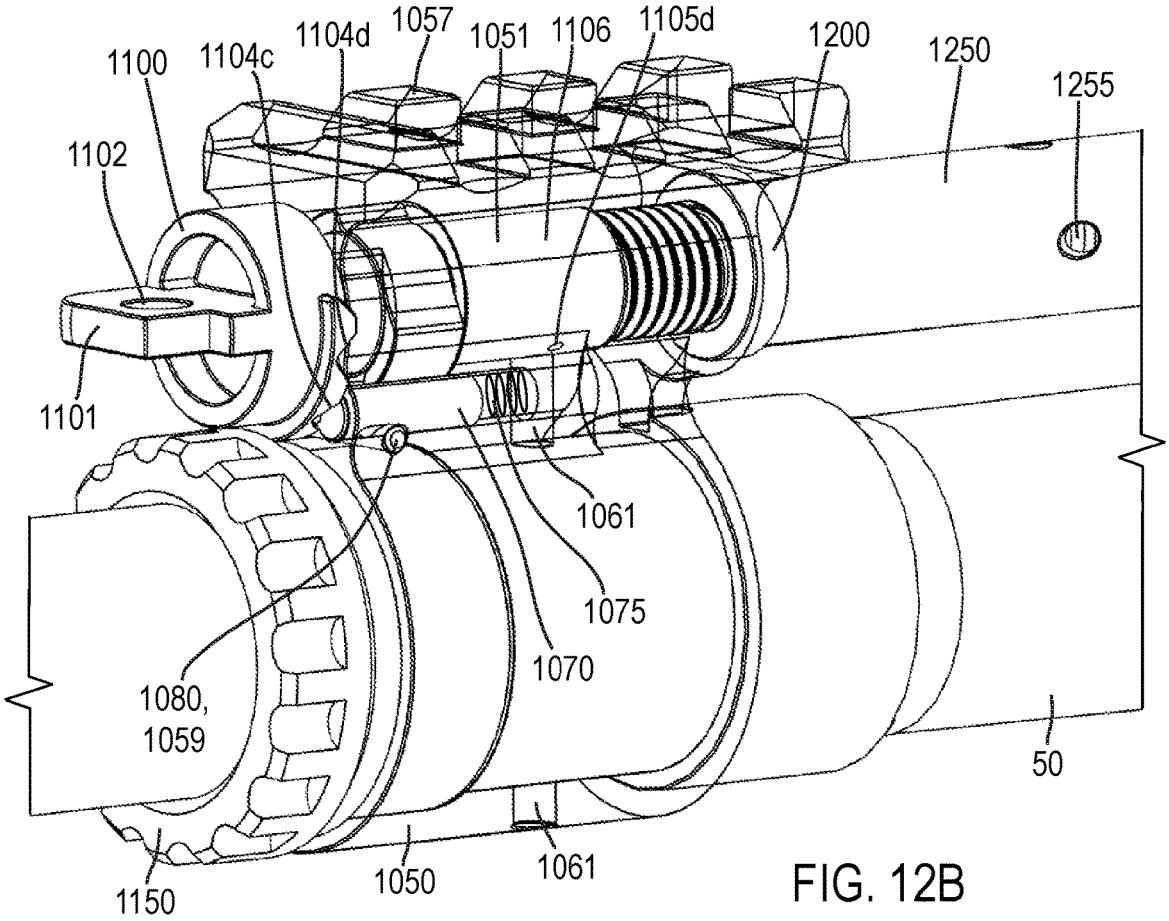
FIG. 12B is a perspective partial view of the firearm operating system of FIG. 1.

FIGS. 12A and 12B show the gas plug 1100 inserted into the upper hole 1053 of the gas block 1050 where the gas block 1050 is transparent to better illustrate some internal features. The firearm operating system 1000 may be designed to be adjustable such that the gas plug 1100 may include multiple configurations or positions relative to the gas block 1050. For example, as shown in FIG. 5A, the gas plug 1100 may include a plurality of gas holes 1105 that each provide an adjustment configuration for controlling gas flow through the firearm operating system 1000. The illustrated embodiment shown in FIG. 5A includes four gas holes 1105*a*, 1105*b*, 1105*c*, and 1105*d*. However, the gas plug 1100 may include any number of gas holes 1105 (including as few as 1 or as many as 100) or may include a tapered or angled gap/opening such that the size of the effective gas hole 1105 is continuously or infinitely variable. FIG. 12A shows a configuration where the gas hole 1105*a* (i.e., the largest hole in the gas plug 1100) is aligned with gas hole 1061 of the gas block 1050. In this configuration, gas passes from the barrel 50 through gas port 58 into the gas block 1050 through gas hole 1061 into the gas plug 1100 through gas hole 1105*a* such that the gases enter the central passage 1108 of the gas plug 1100.

Figure 13A:
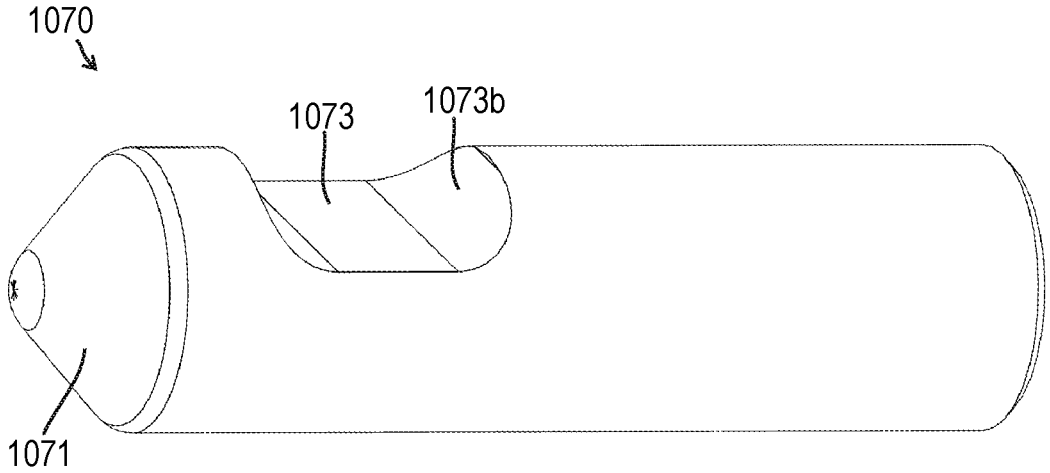
FIG. 13A is a front perspective view of a gas plug plunger of the firearm operating system of FIG. 1.
Figure 13B:
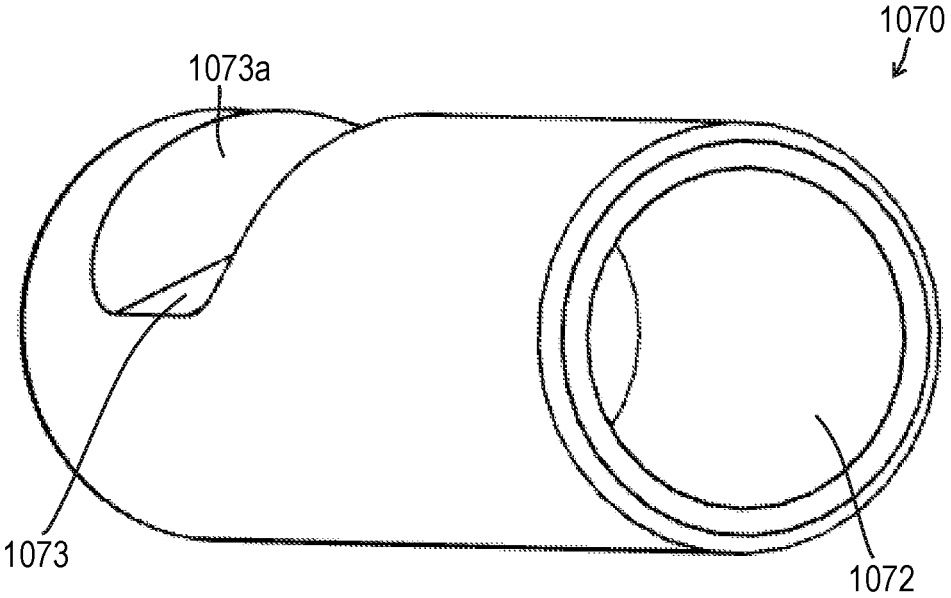
FIG. 13B is a rear perspective view of the gas plug plunger of FIG. 13A.

Rotation of the gas plug 1100 is constrained based on the interaction with the gas plug plunger 1070, which is located within intermediate hole 1058 of the gas block 1050. In some embodiments, the gas plug plunger 1070 functions as a detent for dictating the position of the gas plug 1100. The gas plug plunger 1070 is shown in FIGS. 13A and 13B and may include a forward end 1071, a rear end 1072, and/or a lateral recess 1073. The lateral recess 1073 may include a first limit face 1073*a* and a second limit face 1073*b*. In some embodiments, the forward end 1071 includes a tapered and/or conical surface and the rear end 1072 includes a cylindrical recess. As shown in FIGS. 12A and 12B, a spring 1075 may be located behind the gas plug plunger 1070 within the intermediate hole 1058 and a cross pin 1080 may be located within transverse hole 1059. In some embodiments, the spring 1075 fits within the cylindrical recess of the rear end 1072 such that the spring 1075 pushes the gas plug plunger 1070 within the transverse hole 1059 toward the front of the gas block 1050. In addition, the cross pin 1080 may pass through the lateral recess 1073 to limit travel of the gas plug plunger 1070 relative to the gas block 1050.

When the gas plug 1100 is in the configuration shown in FIG. 12A, the gas plug plunger 1070 is pushed forward (by the spring 1075) such that the forward end 1071 engages notch 1104*a* of the gas plug 1100. In other words, notch 1104*a* corresponds to gas hole 1105*a*. In some embodiments, the cross pin 1080 prevents the gas plug plunger 1070 from falling out of the gas block 1050 and prevents the gas plug plunger 1070 from being pushed too far into the gas block 1050 (which could damage spring 1075). In some embodiments, when the gas plug 1100 is removed from the gas block 1050, the cross pin 1080 would interface with the second limit face 1073*b* to prevent the gas plug plunger 1070 from falling out of the gas block 1050 (due to pressure from the spring 1075). However, when the gas plug 1100 is installed in the gas block 1050 and the gas plug plunger 1070 engages one of the notch(es) 1104, the cross pin 1080 would not interface with either of the limit faces of the lateral recess 1073. In some embodiments, the cross pin 1080 would only interface with the first limit face 1073*a* if the forward end 1071 of the gas plug plunger 1070 is pushed inward beyond the surface of the forward end 1051 (i.e., beyond the positions dictated by operation/rotation of the gas plug 1100).

To adjust the gas flowing through the system, the operator can use the handle 1101 to rotate the gas plug 1100. For example, using the configuration shown in FIG. 12A as a starting point, the operator turns the handle 1101 clockwise. The surfaces of the notch 1104*a* push the forward end 1071 such that the gas plug plunger 1070 moves rearward further into the intermediate hole 1058 compressing the spring 1075. Once the gas plug plunger 1070 has retracted sufficiently, the gas plug 1100 can be rotated while the forward end 1071 rides on the rear surface of the flange 1103. In some embodiments, the operator rotates the gas plug 1100 until the gas plug plunger 1070 reaches the next position where the forward end 1071 engages notch 1104*b*. As shown in FIG. 5A, notch 1104*b* corresponds to gas hole 1105*b*. The rotation of the gas plug 1100 can be facilitated by gripping the handle 1101, by inserting an tool/object (such as a cartridge) into the handle hole 1102, and/or any other method.

Further adjustment of embodiments of the gas plug 1100 illustrated in the drawings is accomplished similar to the description above where notch 1104*c* corresponds to gas hole 1105*c* and notch 1104*d* corresponds to gas hole 1105*d*. As one example, FIG. 12B shows the gas plug 1100 adjusted such that notch 1104*c* is engaging the gas plug plunger 1070 such that gas hole 1105*c* is aligned with gas hole 1061 of the gas block 1050. The gas plug 1100 may include an additional notch 1104 that does not correspond to a gas hole. In other words, the additional notch 1104 could allow the operator to turn the gas "off" to operate the firearm in an analogous manner to a bolt-action rifle (i.e., the bolt carrier group 20 does not cycle without manual operation).

Figure 12C:
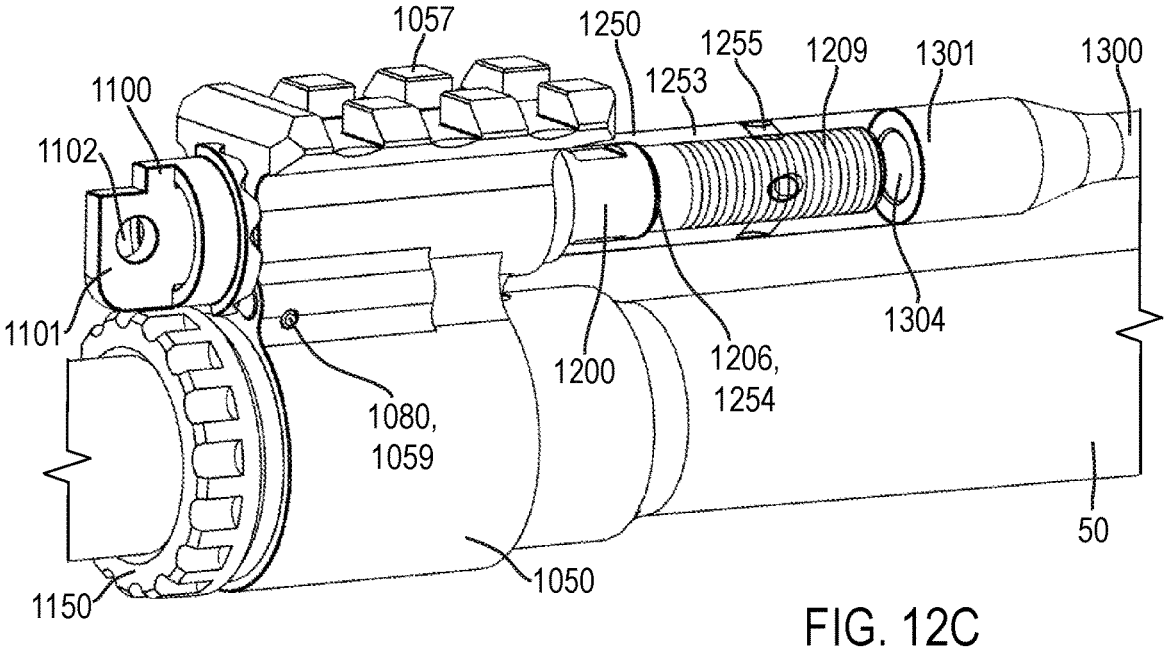
FIG. 12C is a perspective partial view of the firearm operating system of FIG. 1.

After gases enter the gas plug 1100 (i.e., through one of the gas hole(s) 1105), the gases enter the central passage 1108 and proceed rearward toward the gas piston 1200 (see FIGS. 12B and 12C). In some embodiments, the forward attachment portion 1208 removably attaches the gas piston 1200 to the rear attachment feature 1055 of the gas block 1050. The forward attachment portion 1208 and the rear attachment feature 1055 may be a threaded connection as shown in the drawings and/or any other relevant mechanical or chemical attachment. In some embodiments, there is at least one tool interface portion 1207 that allows a tool (e.g., a wrench) to be used to attach/tighten the gas piston 1200 relative to the gas block 1050. After exiting the central passage 1108 and the upper hole 1053, the gases enter the central passage 1203 of the gas piston 1200 at the forward end 1201. The gases move through the gas piston 1200 toward the rear end 1202 before exiting into the internal cavity 1253 of the piston cup 1250.

FIG. 12C shows the gas piston 1200 with the forward end 1201 attached to the gas block 1050 and the rear end 1202 inserted into the internal cavity 1253 of the piston cup 1250 where the piston cup 1250 is transparent to better illustrate some internal features. As shown in FIGS. 7A-7D, in some embodiments, the internal cavity 1253 does not extend through the rear end 1252 of the piston cup 1250. When the firearm operating system 1000 is in the equilibrium configuration as shown in the drawings, the operating rod spring 1340 pushes the operating rod 1300 to a forward position. The operating rod spring 1340 may be disposed between the flange 1303 of the operating rod 1300 and the forward hole 1354 of the operating rod guide 1350. In some embodiments, as shown in FIG. 12C, the outer feature 1206 of the gas piston 1200 engages the internal feature 1254 of the piston cup 1250 when the firearm operating system 1000 is in the equilibrium configuration. This interface may act as a seal such that the volume of the internal cavity 1253 is closed. Accordingly, when gases exit the rear end 1202 of the gas piston 1200, the gases fill the volume of the internal cavity 1253 and create a force that pushes the piston cup 1250 rearward. The excess gases are vented out of the internal cavity 1253 through the gas port(s) 1255. The rear protrusion 1256 of the piston cup 1250 may be located within the internal cavity 1304 of the operating rod 1300. Based on this interface, the forces imparted from the gases into the piston cup 1250 are transferred to the operating rod 1300. In particular, the rear end 1252 of the piston cup 1250 pushes on the forward end 1301 of the operating rod 1300. The force causes the operating rod 1300 to move rearward compressing the operating rod spring 1340 such that the rear end 1302 of the operating rod 1300 pushes the bolt carrier group 20 rearward (i.e., cycles the action of the firearm). In some embodiments, during cycling, the operating rod 1300 slides through the central cavity 1353 of the operating rod guide 1350.

Some embodiments of the handguard 40 are illustrated in FIGS. 1 and 14A-14D. The handguard 40 may include a forward end 41, a rear end 42, an upper feature 43, a plurality of openings 44, at least one fastener 45, at least one attachment portion 46, at least one attachment portion fastener 47, at least one alignment portion 48, and/or a forward cutout 49. The handguard 40 may include the forward cutout 49 such that the upper feature 1057 of the gas block 1050 extends through the forward cutout 49 such that the upper feature 43 of the handguard 40 and the upper feature 1057 of the gas block 1050 are aligned with one another (see FIGS. 1, 4A, and 4B). In some embodiments, the upper feature 43 and the upper feature 1057 are rail(s) for attaching one or more components to the firearm. The rail may be a Picatinny rail (MIL-STD-1913 rail or STANAG 2324 rail), a Weaver rail, or any other appropriate rail. Although not shown in the drawings, in some embodiments, the upper feature 43 extends to the forward end 41 such that the handguard 40 does not include the forward cutout 49. Such a handguard may be compatible with a gas block 1050 that does not include the upper feature (see FIG. 4C) where the gas block 1050 would fit inside the handguard 40.

Figure 4D:
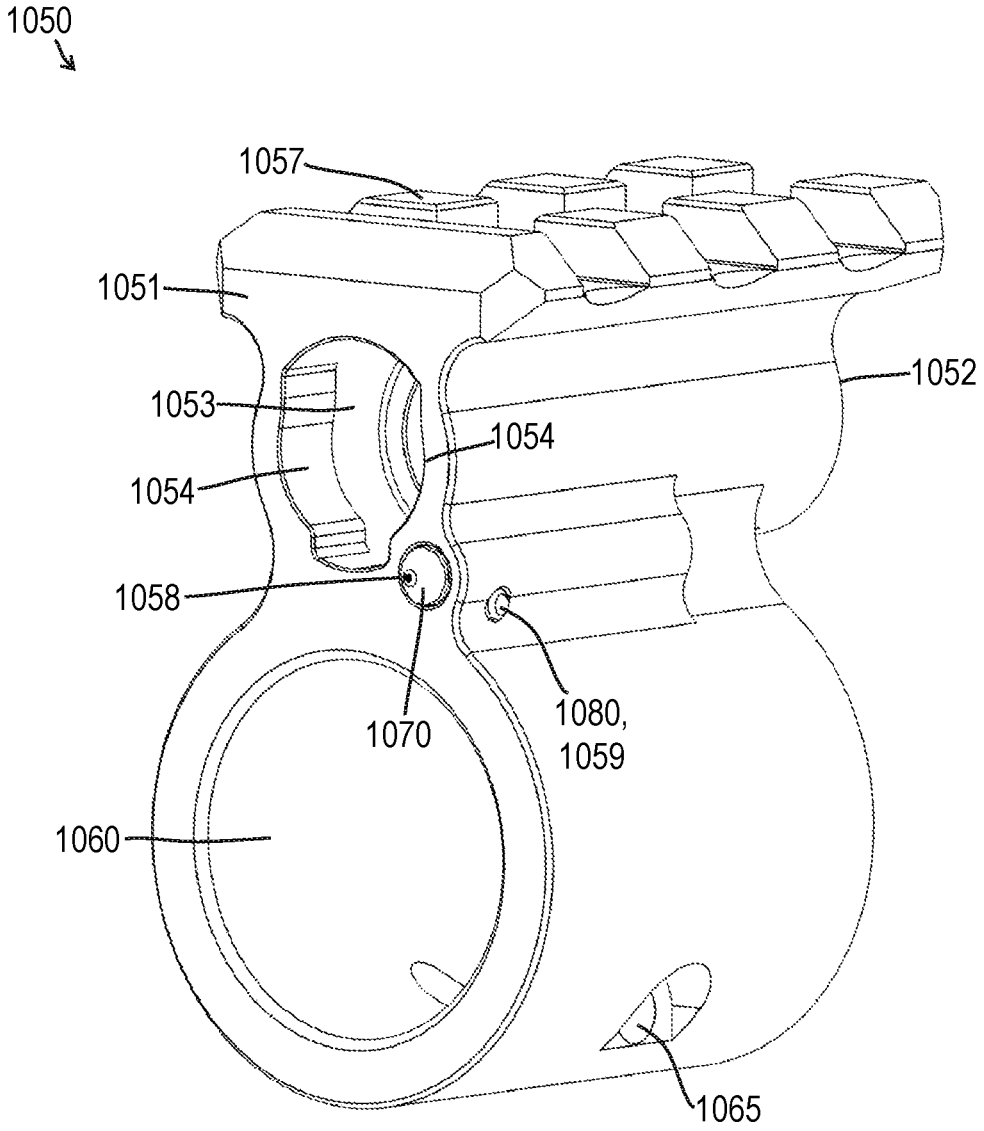
FIG. 4D is a front perspective view of a gas block of the firearm operating system of FIG. 1.

As shown in FIG. 4D, in some embodiments, the gas block 1050 does not include an inner feature 1062 and/or is not designed to interface with a nut (e.g., tension nut 1150). The gas block 1050 may be designed to be pinned onto the barrel 50. For example, the gas block 1050 may include a hole 1065 while the barrel 50 includes a corresponding feature (a hole, a pocket, a flat area, or any other appropriate feature) such that a pin can be inserted into hole 1065 to secure the gas block 1050 relative to the barrel 50. The hole 1065 may be configured in an approximate circumferential direction (as illustrated) or may be configured in an approximate radial direction. In some embodiments, the hole 1065 is designed for a set screw that would allow the gas block 1050 to be secured to the barrel 50.

The at least one attachment portion 46 is illustrated as a quick detachable mount with separate fasteners 47. However, the at least one attachment portion 46 may be a rail or any other component designed to attach components to the handguard 40. The handguard 40 may also be designed such that the openings 44 can be used to attach a component or accessory to the handguard 40. In some embodiments, the openings 44 may be a rail interface attachment including, for example, a modular lock, a key shaped modular rail system, a Picatinny rail (MIL-STD-1913 rail or STANAG 2324 rail), a Weaver rail, or any other appropriate rail.

Figure 14A:
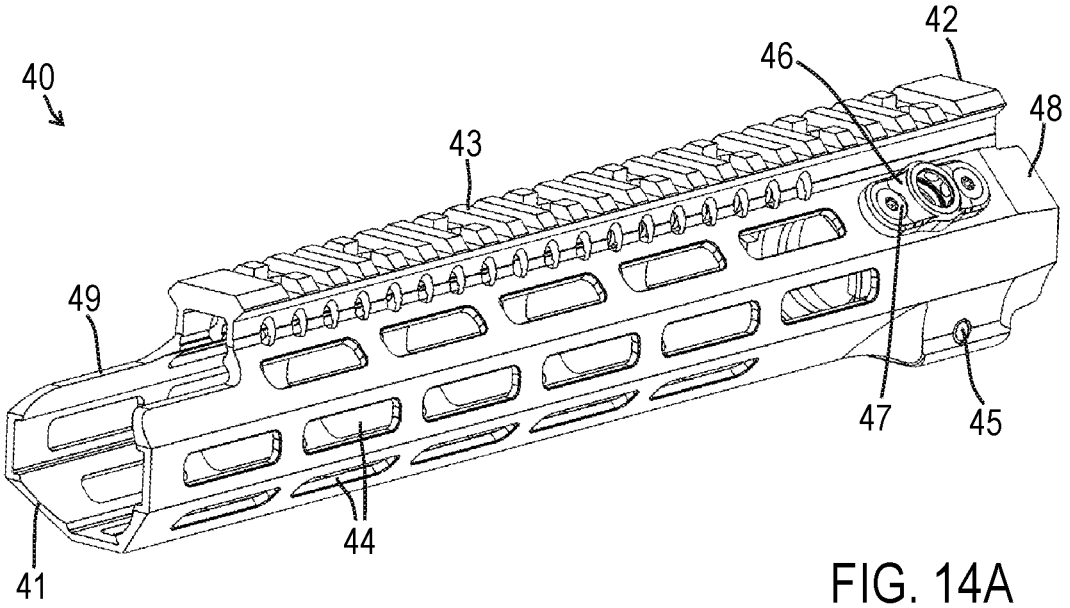
FIG. 14A is a front perspective view of a handguard of the firearm upper receiver assembly of FIG. 1.
Figure 14B:
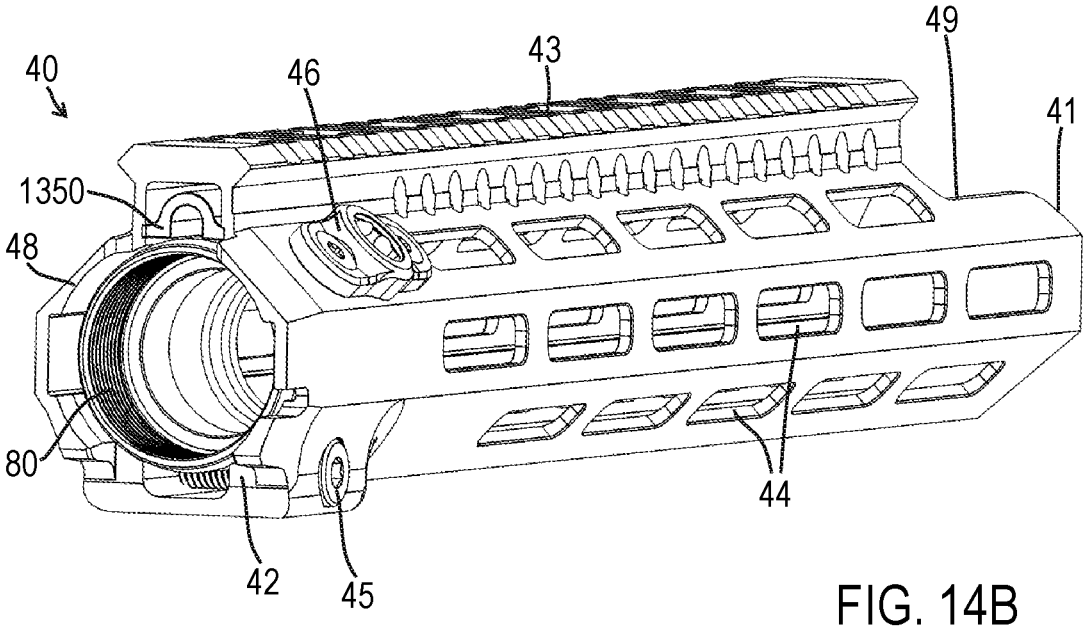
FIG. 14B is a rear perspective view of the handguard of FIG. 14A.
Figure 14C:
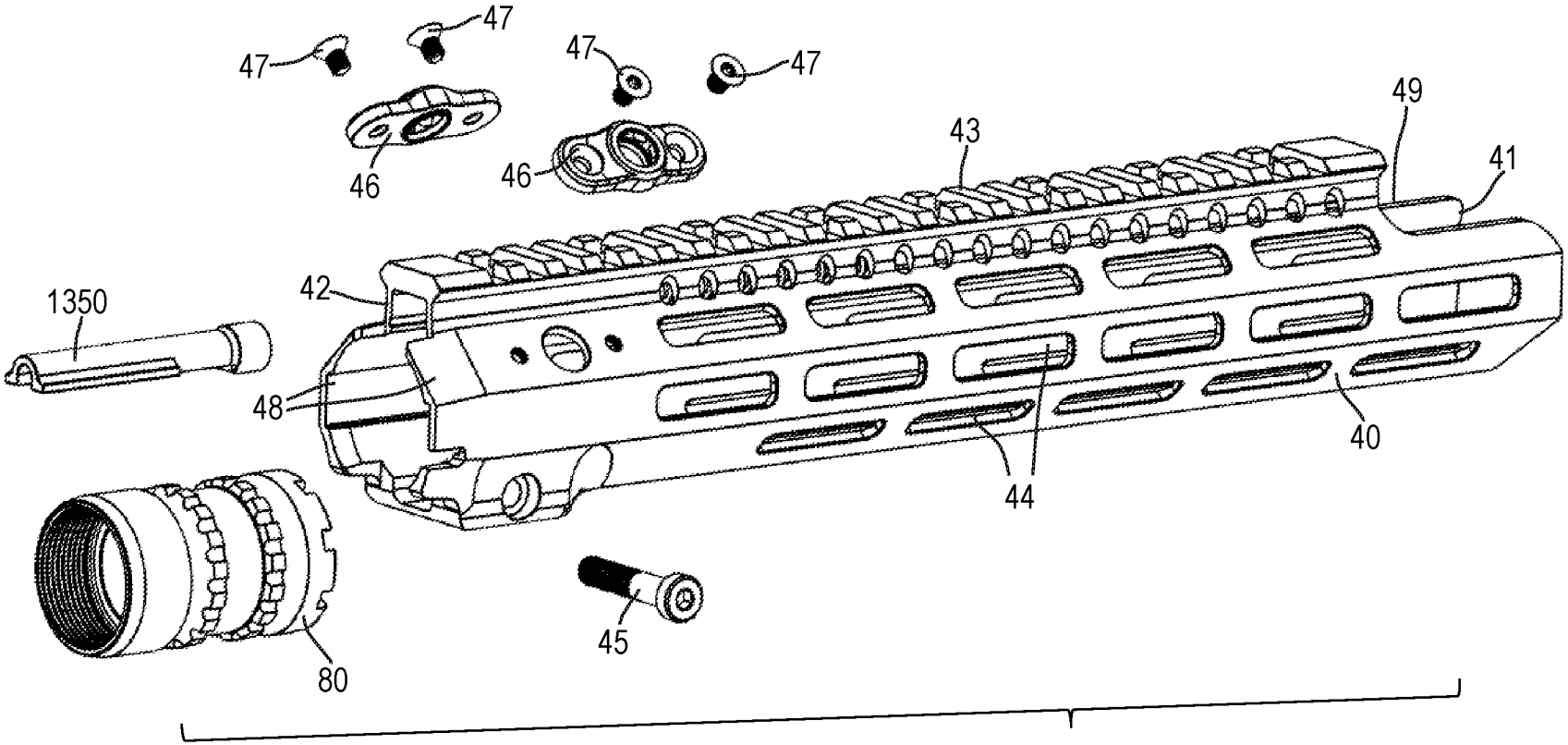
FIG. 14C is a rear perspective exploded view of the handguard of FIG. 14A.
Figure 14D:
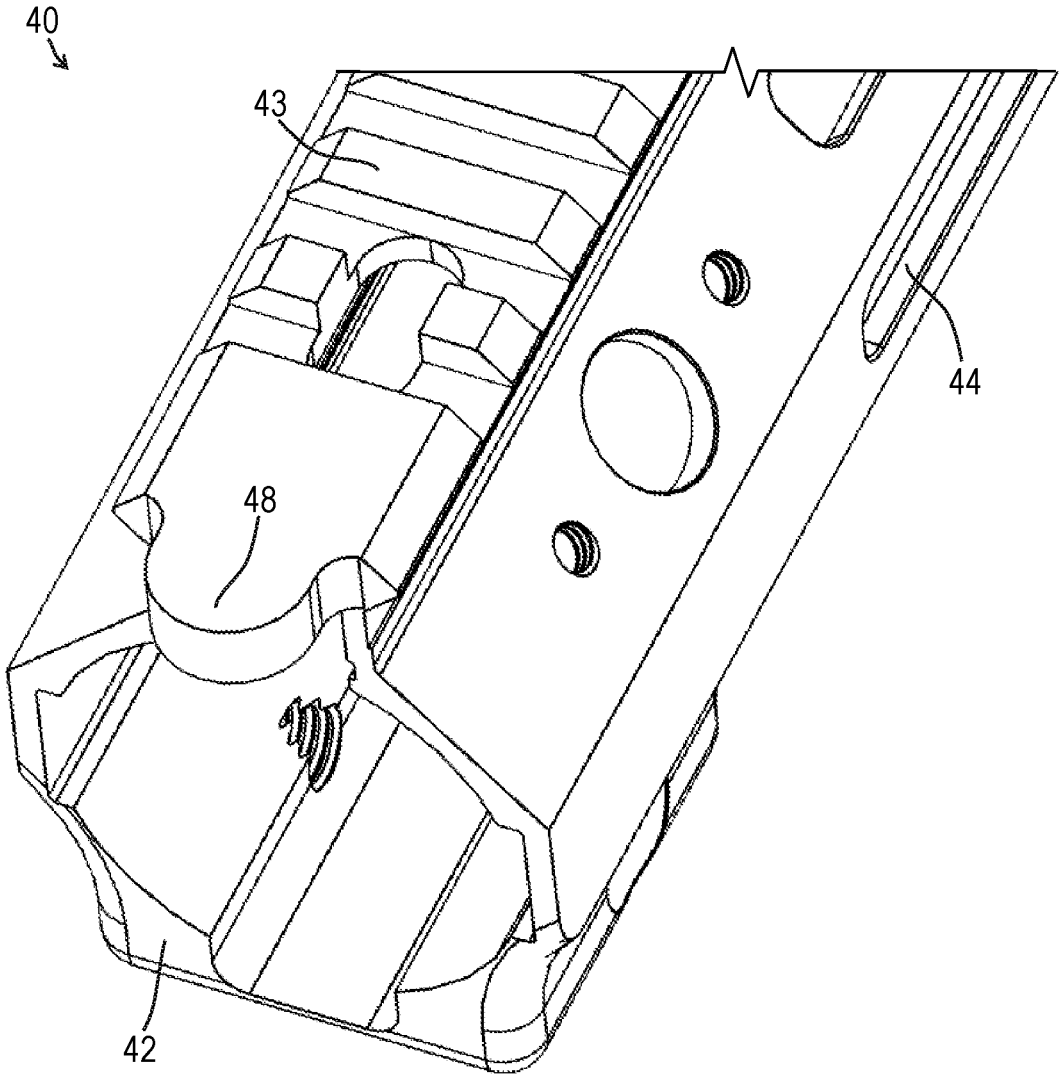
FIG. 14D is a perspective detail view of a handguard of the firearm upper receiver assembly of FIG. 1.

For securing the handguard 40 relative to the firearm, the handguard 40 may include (i) at least one fastener 45 that engages a corresponding groove in the barrel nut 80 for constraining movement in the axial direction of the firearm (i.e., see direction X in FIGS. 1-2B) and (ii) at least one alignment portion 48 that engages the upper receiver 30 for constraining rotational movement about the axial direction of the firearm. In some embodiments, as shown in FIGS. 1 and 14A-14C, the at least one alignment portion 48 includes a pair of wings or arms that that extend adjacent to each side of the upper receiver 30. In other embodiments, as shown in FIG. 14D, the at least one alignment portion 48 includes a single protrusion that extends rearward from the upper feature 43 of the handguard 40. In such embodiments, the upper receiver 30 would include a corresponding recess or cavity for engaging the alignment portion 48.

In some embodiments, the firearm operating systems 1000 is modular and can be configured as a direct impingement (DI) gas system. For example, as shown in FIGS. 15-18B, some piston components (e.g., the gas piston 1200, the piston cup 1250, the operating rod 1300, the operating rod spring 1340, etc.) may be replaced by a gas fitting 2200, a gas tube attachment member 2250, and a gas tube 2300. Other components (such as the gas block 1050, the gas plug 1100, the tension nut 1150, etc.) may be compatible with multiple configurations (e.g., both piston and DI systems).

Figure 16A:
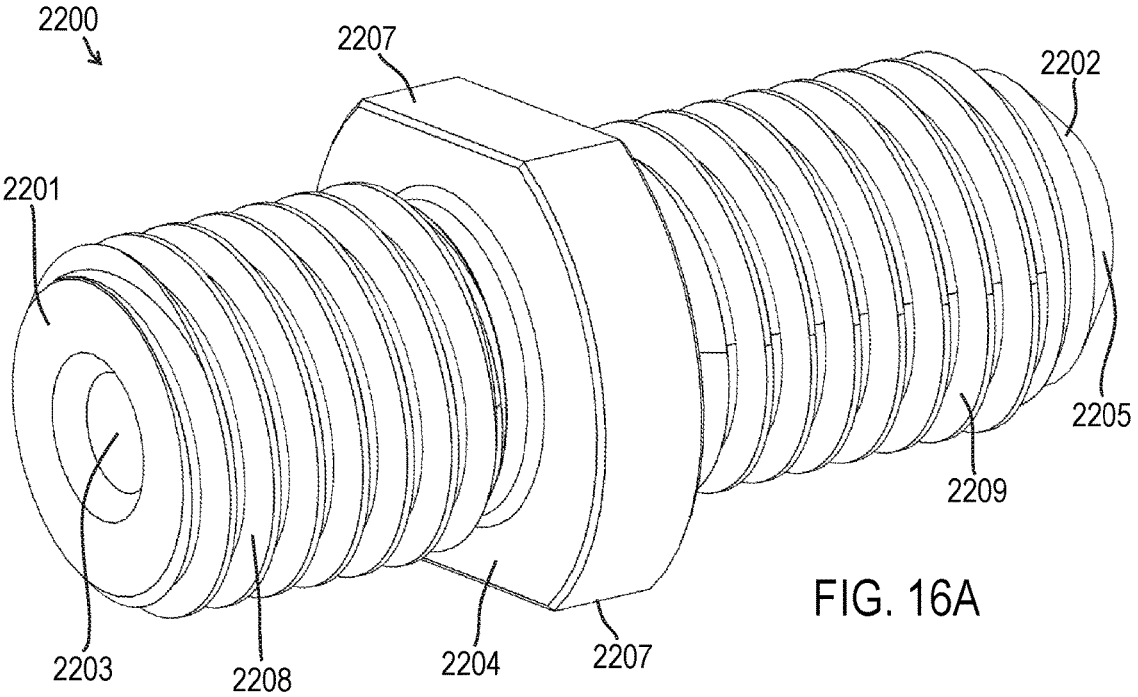
FIG. 16A is a front perspective view of a gas fitting of the firearm operating system of FIG. 15.
Figure 16B:
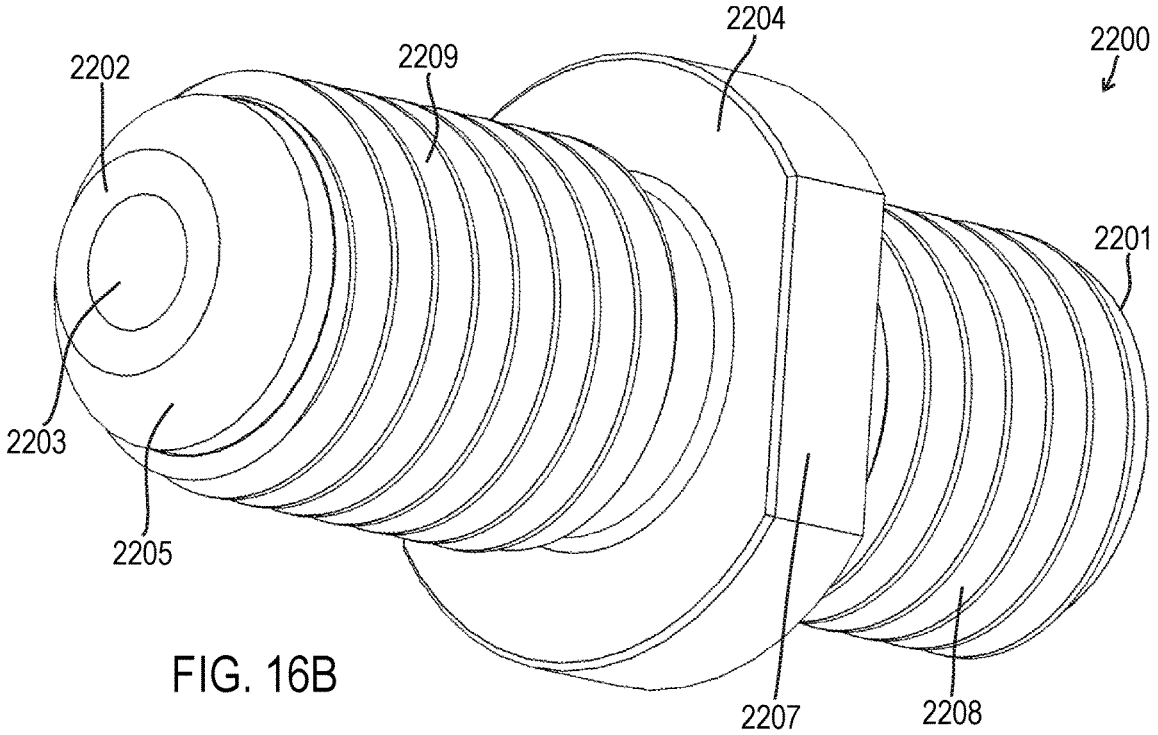
FIG. 16B is a rear perspective view of the gas fitting of FIG. 16A.

As shown in FIGS. 16A and 16B, the gas fitting 2200 may include a forward end 2201, a rear end 2202, a central passage 2203, a flange 2204, a rear taper 2205, at least one tool interface portion 2207, a forward attachment portion 2208, and/or a rear attachment portion 2209. The forward attachment portion 2208 may interface with the rear attachment feature 1055 to attach the gas fitting 2200 to the gas block 1050 similar to the removable attachment discussed above in the context of the gas piston 1200.

Figure 15:
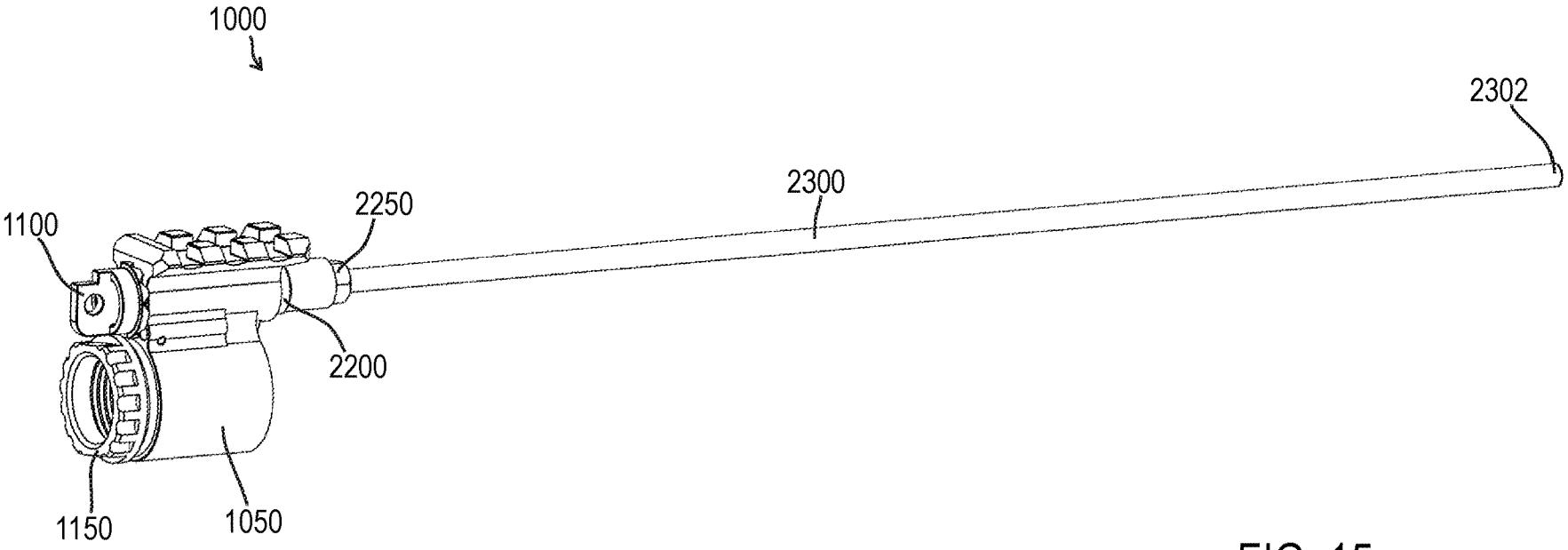
FIG. 15 is a front perspective partial view of the firearm operating system of FIG. 1.
Figure 17A:
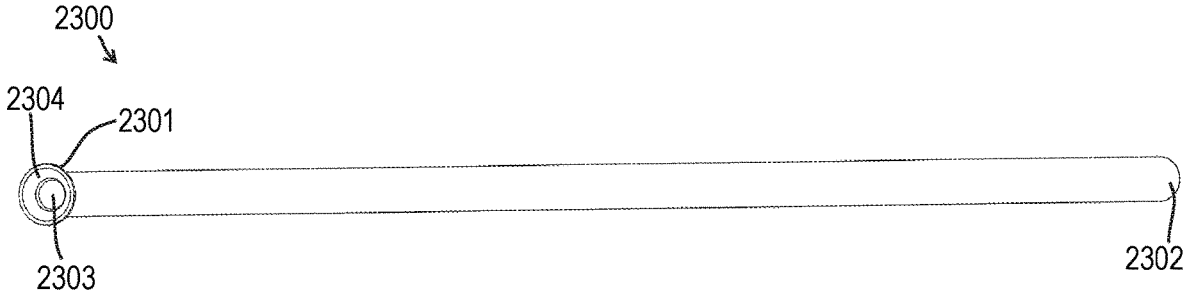
FIG. 17A is a front perspective view of a gas tube of the firearm operating system of FIG. 15.
Figure 17B:
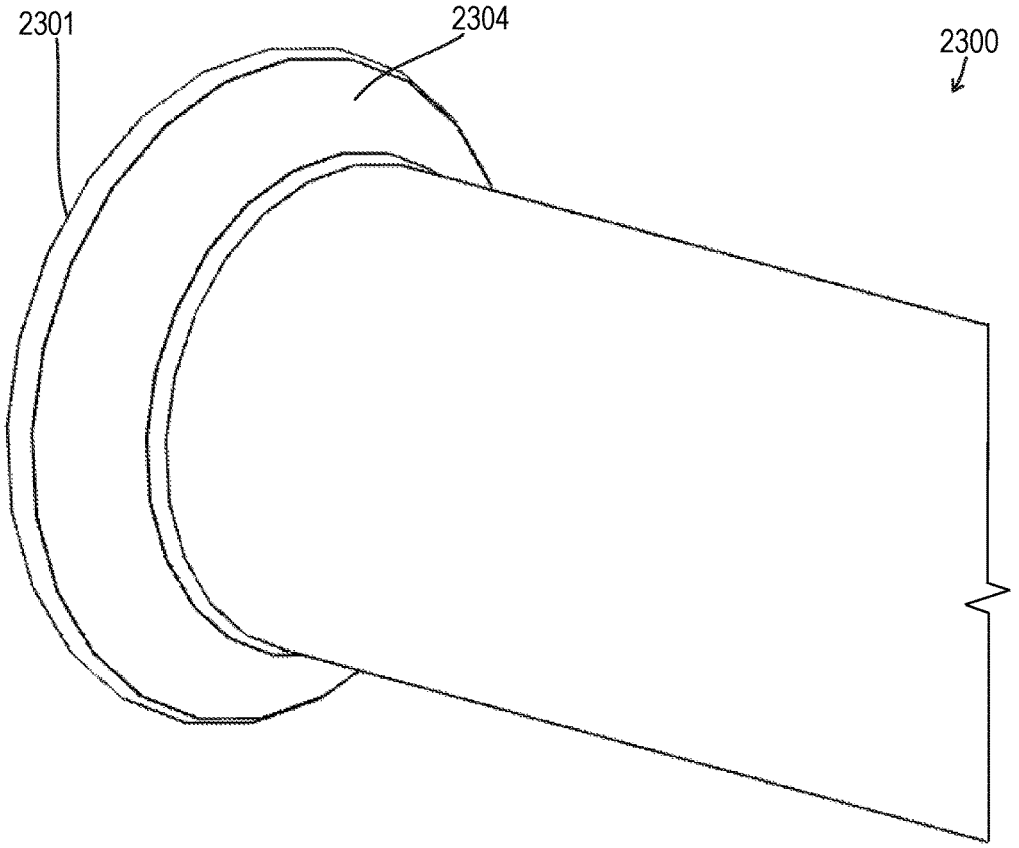
FIG. 17B is a rear perspective detail view of the gas tube of FIG. 17A.

Some embodiments of the gas tube 2300 are illustrated in FIGS. 15, 17A, and 17B. The gas tube 2300 may include a forward end 2301, a rear end 2302, a central passage 2303, and/or a flare 2204.

Figure 18A:
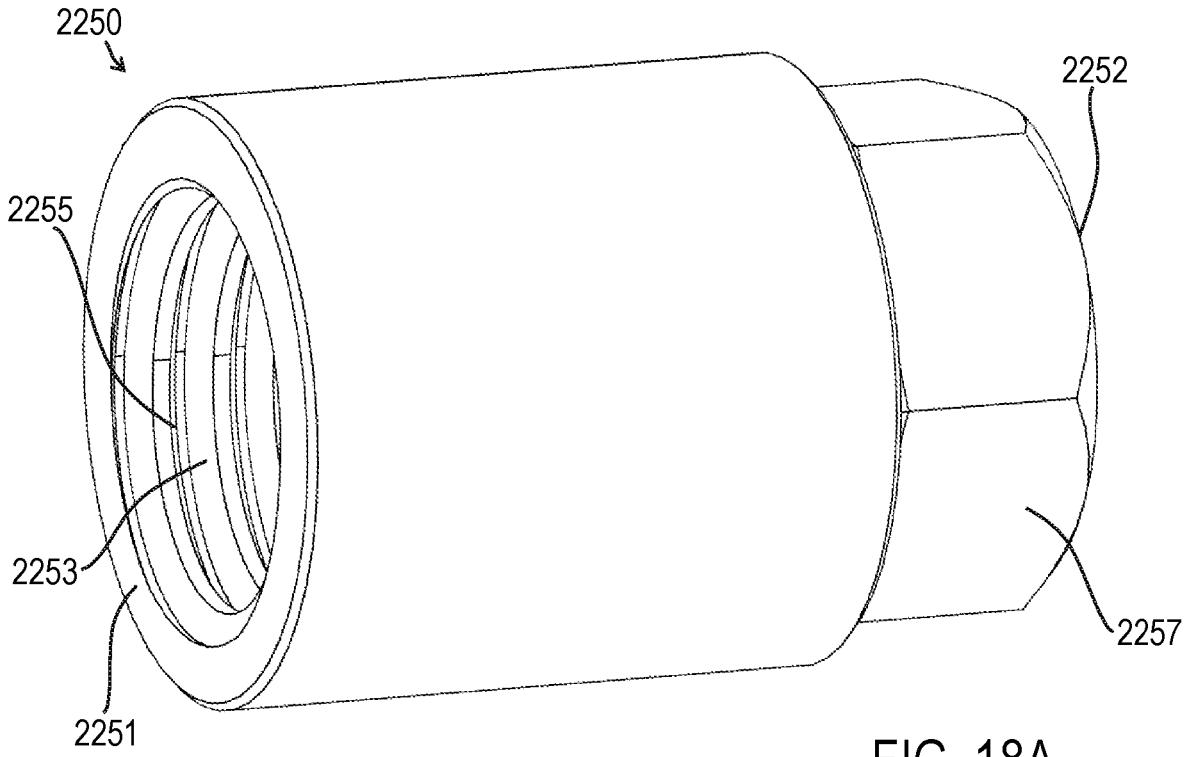
FIG. 18A is a front perspective view of a gas tube attachment member of the firearm operating system of FIG. 15.
Figure 18B:
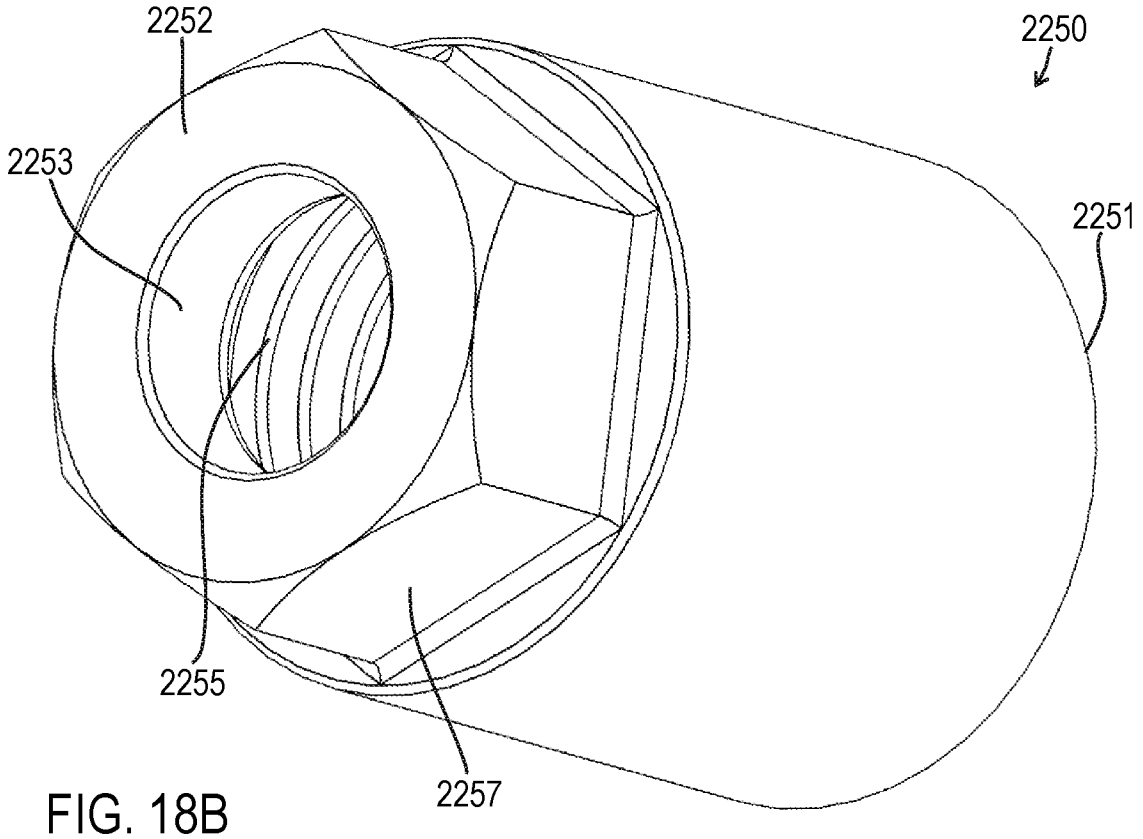
FIG. 18B is a rear perspective view of the gas tube attachment member of FIG. 18A.

As shown in FIGS. 18A and 18B, the gas tube attachment member 2250 may include a forward end 2251, a rear end 2252, a central passage 2253, an attachment portion 2255, and/or at least one tool interface portion 2257.

To assemble the DI components, as described above, the gas fitting 2200 is attached to the rear of the gas block 1050. The gas tube attachment member 2250 is arranged such that the rear end 2302 of the gas tube 2300 passes through the central passage 2253 and out the rear end 2252. The attachment portion 2255 may then be engaged with the rear attachment portion 2209 such that the flare 2204 of the gas tube 2300 is sandwiched between the rear taper 2205 and an internal surface of the gas tube attachment member 2250. In some embodiments, these corresponding attachment portions include matching threaded portions such that the components may be removably attached to one another. There may be at least one tool interface portion 2257 that allows a tool (e.g., a wrench) to be used to attach/tighten the gas tube attachment member 2250 relative to the gas fitting 2200.

During operation gases pass through the gas block 1050 and the gas plug 1100 as described above in the context of the piston system before entering the central passage 2203 of the gas fitting 2200 at the forward end 2201. The gases flow through the central passage 2203 to the rear end 2202 where the gases are directed into the central passage 2303 of the gas tube 2300 at the forward end 2301. The gases proceed through the central passage 2303 and exit through the rear end 2302 where the gases push the bolt carrier group 20 rearward (i.e., cycles the action of the firearm).

The components of any of the firearm operating systems 1000 described herein may be formed of materials including, but not limited to, thermoplastic, carbon composite, plastic, nylon, glass-filled nylon, steel, aluminum, stainless steel, tool steel, high strength aluminum alloy, titanium, other plastic or polymer materials, other metallic materials, other composite materials, or other similar materials. Moreover, the components of the firearms may be attached to one another via suitable fasteners, which include, but are not limited to, screws, bolts, rivets, welds, co-molding, injection molding, or other mechanical or chemical fasteners.

Different arrangements of the components depicted in the drawings or described above, as well as components and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

That which is claimed is:

1. A firearm operating system for a firearm with a barrel and a bolt carrier group, the firearm operating system comprising:

a gas block secured to the barrel, the gas block comprising a rear attachment feature and an upper hole;

a gas plug disposed in the upper hole;

a tension nut disposed on a forward side of the gas block; and a removably attached gas directing assembly, wherein:

the gas plug comprises multiple adjustment configurations;

the removably attached gas directing assembly interfaces with the bolt carrier group;

the rear attachment feature comprises a threaded connection; and the firearm operating system is modularly designed to function as a piston-driven system or a direct impingement system.

2. The firearm operating system of claim 1, wherein the gas plug comprises a cylindrical body and a plurality of gas holes, wherein each gas hole is a different size.

3. The firearm operating system of claim 2, wherein:

the gas plug comprises a plurality of notches that each correspond to one of the plurality of gas holes; and the gas block comprises a gas plug plunger that engages the notches to position the gas plug relative to the gas block.

4. The firearm operating system of claim 1, wherein the gas plug comprises a handle extending from a front of the gas block.

5. The firearm operating system of claim 1, wherein the gas block comprises a rear locating feature that extends rearward from the gas block and engages a corresponding feature of the barrel.

6. The firearm operating system of claim 1, wherein the removably attached gas directing assembly comprises:

a gas piston removably attached to the threaded rear attachment feature of the gas block;

a piston cup disposed on a rear side of the gas piston;

an operating rod disposed on a rear side of the piston cup; and an operating rod spring.

7. The firearm operating system of claim 6, wherein a majority of the gas piston is disposed within an internal cavity of the piston cup.

8. The firearm operating system of claim 6, wherein:

the piston cup comprises a plurality of gas ports for expelling excess gases; and the gas ports are oblique relative to the forward/aft axial direction of the piston cup.

9. The firearm operating system of claim 1, wherein the removably attached gas directing assembly comprises:

a gas fitting removably attached to the threaded rear attachment feature of the gas block;

a gas tube attachment member removably attached to the gas fitting; and a gas tube.

10. The firearm operating system of claim 9, wherein a portion of the gas tube is disposed between a portion of the gas fitting and a portion of the gas tube attachment member.

11. A firearm operating system for a firearm with a barrel and a bolt carrier group, the firearm operating system comprising:

a gas block secured to the barrel, the gas block comprising an upper hole;

a gas plug disposed in the upper hole; and a removably attached modular gas directing assembly, wherein:

the upper hole comprises at least two front attachment features;

the gas plug comprises at least two locking features such that the gas plug must be indexed for the at least two locking features to avoid the at least two front attachment features during insertion of the gas plug into the upper hole;

the gas plug comprises at least two adjustment configurations;

the removably attached modular gas directing assembly interfaces with the bolt carrier group; and wherein the gas plug comprises at least one gas hole that extends in a direction that is non-parallel to a longitudinal axis of the gas plug.

12. The firearm operating system of claim 11, wherein the gas plug comprises a cylindrical body and wherein each of the at least one gas hole is a different size.

13. The firearm operating system of claim 12, wherein: the gas plug comprises a plurality of notches that each correspond to one of the at least one gas hole; and the gas block comprises a gas plug plunger that engages the notches to position the gas plug relative to the gas block.

14. The firearm operating system of claim 11, wherein the gas plug comprises a handle extending from a front of the gas block.

15. The firearm operating system of claim 11, wherein:

the removably attached modular gas directing assembly comprises a gas piston that is removably attached to a rear feature of the gas block; and the gas piston directs gases causing an operating rod to move rearward.

16. The firearm operating system of claim 15, wherein the removably attached modular gas directing assembly further comprises a piston cup disposed on a rear side of the gas piston and an operating rod spring that biases the operating rod forward.

17. The firearm operating system of claim 16, wherein a majority of the gas piston is disposed within an internal cavity of the piston cup.

18. The firearm operating system of claim 16, wherein:

the piston cup comprises a plurality of gas ports for expelling excess gases; and the gas ports are oblique relative to the forward/aft axial direction of the piston cup.

19. The firearm operating system of claim 11, wherein:

the removably attached modular gas directing assembly comprises a gas fitting that is removably attached to a rear feature of the gas block; and the gas fitting directs gases through a gas tube such that the gases interface with the bolt carrier group.

20. The firearm operating system of claim 11, wherein the removably attached modular gas directing assembly comprises at least one selected from the group of a piston system or a direct impingement gas system.

* * * * *